US011341917B2

(12) United States Patent
Shim et al.

(10) Patent No.: US 11,341,917 B2
(45) Date of Patent: May 24, 2022

(54) LIGHT EMITTING DISPLAY DEVICE AND DRIVING METHOD THEREOF

(71) Applicant: LG Display Co., Ltd., Seoul (KR)

(72) Inventors: Da-Hye Shim, Seoul (KR); Eui-Hyun Chung, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/071,572

(22) Filed: Oct. 15, 2020

(65) Prior Publication Data

US 2021/0118370 A1 Apr. 22, 2021

(30) Foreign Application Priority Data

Oct. 16, 2019 (KR) ..... 10-2019-0128593

(51) Int. Cl.

| | |
|---|---|
| ***G09G 3/00*** | (2006.01) |
| ***G09G 3/3258*** | (2016.01) |
| *G09G 3/3266* | (2016.01) |
| *G09G 3/3275* | (2016.01) |

(52) U.S. Cl.

CPC ..... *G09G 3/3258* (2013.01); *G09G 3/3266* (2013.01); *G09G 3/3275* (2013.01); *G09G 2300/0426* (2013.01); *G09G 2300/0452* (2013.01); *G09G 2300/0809* (2013.01); *G09G 2310/0243* (2013.01); *G09G 2310/0286* (2013.01); *G09G 2310/0289* (2013.01); *G09G 2310/08* (2013.01); *G09G 2320/02* (2013.01); *G09G 2330/02* (2013.01); *G09G 2330/08* (2013.01)

(58) Field of Classification Search

None

See application file for complete search history.

(56) References Cited

U.S. PATENT DOCUMENTS

| | | | | |
|---|---|---|---|---|
| 2017/0076654 | A1* | 3/2017 | Wang | G09G 3/2074 |
| 2017/0249915 | A1* | 8/2017 | Xi | G02F 1/133 |
| 2018/0231836 | A1* | 8/2018 | Suzuki | G09G 3/3648 |

FOREIGN PATENT DOCUMENTS

| | | | |
|---|---|---|---|
| KR | 10-2017-0126183 | A | 11/2017 |
| KR | 10-2018-0003703 | A | 1/2018 |
| KR | 10-2018-0055004 | A | 5/2018 |

* cited by examiner

*Primary Examiner* — Michael A Faragalla

(74) *Attorney, Agent, or Firm* — Birch, Stewart, Kolasch & Birch, LLP

(57) ABSTRACT

A light emitting display device includes a display panel including a display area having sub-pixels for displaying an image and a non-display area that does not display an image; and a shift register including signal generating circuits distributed and arranged in the display area of the display panel and configured to output a signal for turning on or off a transistor included in the sub-pixels, wherein the signal generating circuits simultaneously and respectively output a plurality of signals for driving sub-pixels arranged in the same horizontal line even if being arranged to be spaced apart from each other in the display area.

17 Claims, 19 Drawing Sheets

LIGHT EMITTING DISPLAY DEVICE AND DRIVING METHOD THEREOF

CROSS-REFERENCE TO RELATED APPLICATIONS

This application claims the priority benefit of Korean Patent Application No. 10-2019-0128593, filed in the Republic of Korea on Oct. 16, 2019, the entire contents of which are hereby expressly incorporated by reference as if fully set forth herein into the present application.

BACKGROUND OF THE INVENTION

Field of the Invention

The present disclosure relates to a light emitting display device and a driving method thereof.

Discussion of the Related Art

With the development of information technologies, markets of display devices that are connection media between a user and information have expanded. Thus, display devices such as a light emitting display (LED), a quantum dot display (QDD), and a liquid crystal display (LCD) have been increasingly used.

The aforementioned display devices include a display panel including sub-pixels, a driver for outputting a driving signal for driving the display panel, and a power supply for generating power to be supplied to the display panel or the driver.

The aforementioned display device displays an image by enabling a selected sub-pixel to transmit light therethrough or to directly emit light when a driving signal, e.g., a scan signal and a data signal, is supplied to sub-pixels formed on the display panel.

Among the aforementioned display devices, the LED (the light emitting display) has many advantages such as instrumental characteristics realized in a flexible form as well as electrical or optical characteristics such as a high response speed, high brightness, and a wide viewing angle.

SUMMARY OF THE INVENTION

The present disclosure can realize a narrow bezel based on a structure in which a shift register for outputting a scan signal, etc. for displaying a display panel is distributed and arranged in a display area.

According to the present disclosure, it can be possible to reduce a deviation in output on a surface of the display panel and to also ensure output characteristics (it can be possible to overcome a problem in terms of increase in a load due to the size of the display panel).

According to the present disclosure, it can be possible to enhance display quality (to overcome image failure) by overcoming a problem in terms of driving time due to reduction in signal output (e.g., initialization in the case of external compensation, and reduction in sampling time deviation and error).

In addition, according to the present disclosure, it can be possible to drive a portion (block) for each area of the display panel, and thus, even if a portion of a scan line (or a horizontal line) is cut, it can be possible to normally drive a portion of the scan line.

In an aspect, the present disclosure provides a light emitting display device including a display panel including a display area having sub-pixels for displaying an image and a non-display area that does not display an image, and a shift register including signal generating circuits distributed and arranged in the display area of the display panel and configured to output a signal for turning on or off a transistor included in the sub-pixels, wherein the signal generating circuits simultaneously and respectively output a plurality of signals for driving sub-pixels arranged in the same horizontal line even if being arranged to be spaced apart from each other in the display area.

The signal generating circuits can be disposed one by one in one sub-pixel group defined as a plurality of sub-pixels that are adjacent to each other right and left or up, down, right, and left on one or two horizontal line.

The signal generating circuits can be embodied as switching transistors having channels with the same width and the same length.

The switching transistors can be distributed and arranged in a non-emissive area that does not emit light of the sub-pixels.

The signal generating circuits can be arranged in at least one position of a central portion, a left edge portion, and a right edge portion of the display area or can be distributed and arranged in an entire portion of the display area.

The signal generating circuits can have driving systems that are independent in units of groups and independently drive sub-pixel groups.

The sub-pixel groups can respectively have signal output lines that are separated from each other in units of sub-pixel groups to have independent driving systems in units of groups.

The light emitting display device can further include scan signal generating circuits configured to output a scan signal for tuning on or off a switching transistor included in the sub-pixels, and emissive signal generating circuits configured to output an emissive signal for turning on or off a transistor for controlling emission, included in the sub-pixels.

In another aspect, the present disclosure provides a light emitting display device including a display panel including a display area having sub-pixels for displaying an image and a non-display area that does not display an image, and a shift register including signal generating circuits distributed and arranged in the display area of the display panel and configured to output a signal for turning on or off a transistor included in the sub-pixels, wherein the signal generating circuits are independently driven for each block in the display area and simultaneously and respectively output a plurality of signals for driving sub-pixels arranged in the same horizontal line.

The signal generating circuits can be embodied as switching transistors having channels with the same width and the same length.

The switching transistors can be distributed and arranged in a non-emissive area that does not emit light of the sub-pixels.

In another aspect, the present disclosure provides a driving method of a light emitting display device including a display panel including a display area having sub-pixels for displaying an image and a non-display area that does not display an image, and a shift register including signal generating circuits distributed and arranged in the display area of the display panel and configured to output a signal for turning on or off a transistor included in the sub-pixels.

The driving method of a light emitting display device can include independently driving the signal generating circuits for respective blocks to simultaneously and respectively output a plurality of signals for turning on or off a transistor included in the sub-pixels arranged in the same horizontal line, and applying a data voltage through the transistor turned on by the signal output from the signal generating circuits for allowing the sub-pixels to emit light.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Reference will now be made in detail embodiments of the invention examples of which are illustrated in the accompanying drawings.

A display device according to the present disclosure can be embodied as a television, an image player, a personal computer (PC), a home theater, a vehicle electric device, or a smart phone, but the present disclosure is not limited thereto. The display device according to the present disclosure can be embodied as a light emitting display apparatus (LED), a quantum dot display apparatus (QDD), a liquid crystal display apparatus (LCD), or the like. In the following description, for convenience of description, an LED for displaying an image by directly emitting light will be exemplified. The LED can be embodied based on an inorganic light emitting diode or an organic light emitting diode. Hereinafter, for convenience of description, an example in which the LED is embodied based on an organic light emitting diode will be described.

In the following description, an example in which a sub-pixel includes an n-type thin film transistor will be described, but the sub-pixel can include a p-type thin film transistor or both n-type and p-type thin film transistors. A thin film transistor can be a 3-electrode device including a gate, a source, and a drain. The source can be an electrode for supplying carriers to a transistor. The carriers can begin to flow from the source in the thin film transistor. The drain can be an electrode from which carriers flow to the outside the thin film transistor. For example, the carriers in the thin film transistor can flow to the drain from the source.

In the case of the n-type thin film transistor, a carrier is an electron, and thus, a source voltage is lower than a drain voltage to allow an electron to flow to a drain from a source. An electron flows toward the drain from the source in the n-type thin film transistor, and thus, current can flow in a direction toward the source from the drain. In contrast, in the case of a p-type thin film transistor, a carrier is a hole, and thus, a source voltage can be higher than a drain voltage to allow a hole to flow to a drain from a source. A hole flows toward the drain from the source in the p-type thin film transistor, and thus, current can flow in a direction toward the drain from the source. However, the source and drain of the thin film transistor can be changed depending on an applied voltage. In consideration of this, in the following description, any one of the source and the drain is a first electrode, and the other one of the source and the drain is a second electrode.

Figure 1:
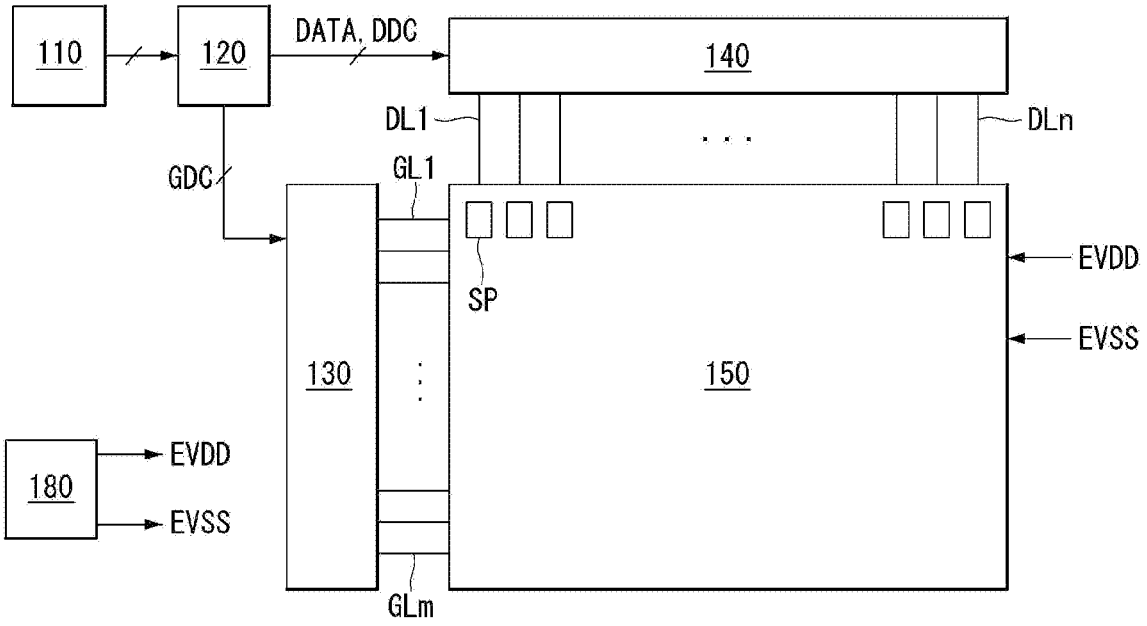
FIG. 1 is a schematic block diagram of an organic light emitting display device according to an embodiment of the present disclosure.
Figure 2:
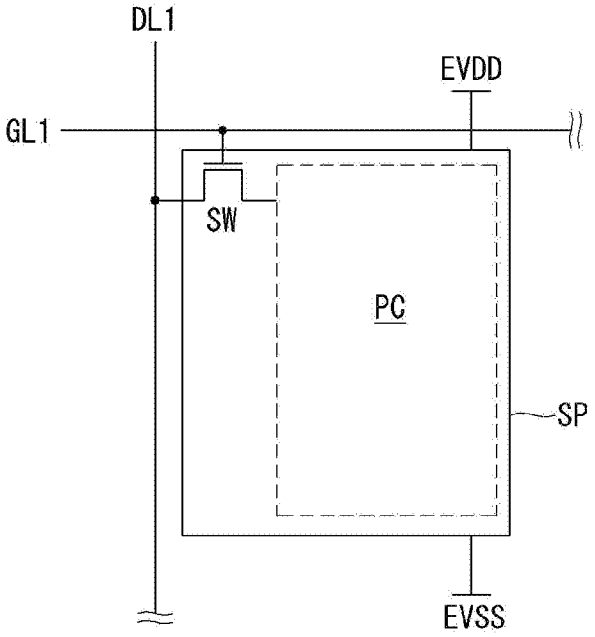
FIG. 2 is a schematic diagram illustrating a structure of a sub-pixel illustrated in FIG. 1.

FIG. 1 is a schematic block diagram of an organic light emitting display device according to an embodiment of the present disclosure, and FIG. 2 is a schematic diagram illustrating a structure of a sub-pixel illustrated in FIG. 1. All the components of the organic light emitting display device according to all embodiments of the present disclosure are operatively coupled and configured.

As shown in FIGS. 1 and 2, the organic light emitting display device according to an embodiment of the present disclosure can include an image display 110, a timing controller 120, a scan driver 130, a data driver 140, a display panel 150, and a power supply 180.

The image display 110 (or a host system) can output various driving signals with an image data signal supplied from the outside or an image data signal stored in an internal memory. The image display 110 can supply a data signal and various driving signals to the timing controller 120.

The timing controller 120 can output a gate timing control signal GDC for controlling operation timing of the scan driver 130, a data timing control signal DDC for controlling operation timing of the data driver 140, and various synchronization signals (vertical synchronization signal Vsync and horizontal synchronization signal Hsync).

The timing controller 120 can supply the data signal DATA supplied from the image display 110 with the data timing control signal DDC to the data driver 140. The timing controller 120 can be installed on a printed circuit board in the form of an integrated circuit (IC), but the present disclosure is not limited thereto.

The scan driver 130 can output a scan signal (or a scan voltage) in response to the gate timing control signal GDC or the like, which is supplied from the timing controller 120. The scan driver 130 can supply the scan signal to sub-pixels (SPs) included in the display panel 150 through gate lines GL1 to GLm, where m is a number such as a positive integer. The scan driver 130 can be directly formed on the display panel 150 in a gate in panel method.

The data driver 140 can sample and latch a data signal DATA in response to the data timing control signal DDC or the like supplied from the timing controller 120, can convert the data signal in a digital form into a data voltage in an analog form based on a gamma reference voltage, and can output the data voltage.

The data driver 140 can supply a data voltage to sub-pixels SPs included in the display panel 150 through data lines DL1 to DLn, where n is a number such as a positive integer. The data driver 140 can be formed in the form of an integrated circuit (IC) and can be installed on the display panel 150 or can be installed on a printed circuit board, but the present disclosure is not limited thereto.

The power supply 180 can generate and output first panel power EVDD of high potential and second panel power EVSS of low potential based on an external input voltage supplied from the outside. The power supply 180 can generate and output a voltage (e.g., a scan high voltage or a scan low voltage) required to drive the scan driver 130 or a voltage (a drain voltage or a half drain voltage) required to drive the data driver 140 as well as the first and second panel power EVDD and EVSS.

The display panel 150 can display an image in response to a driving signal including a scan signal and a data voltage output from a driver including the scan driver 130 and the data driver 140, and the first and second panel power EVDD and EVSS output from the power supply 180. The display panel 150 can have a display area for displaying an image and a non-display area that does not display an image. Sub-pixels SPs of the display panel 150 can directly emit light.

The display panel 150 can be manufactured based on a rigid or flexible substrate such as glass, silicon, or polyimide. Sub-pixels that emit light can include a pixel containing red, green, and blue or a pixel containing red, green, and white.

For example, one sub-pixel SP can include the switching transistor SW, and pixel circuit PC including a driving transistor, a storage capacitor, an organic light emitting diode, or the like. The sub-pixel SP used in the organic light emitting display device can directly emit light and can have a complicated circuit structure. In addition, a compensation circuit for compensating for degradation of a driving transistor for supplying driving current to an organic light emitting diode as well as the organic light emitting diode for emitting light can be diversified. Thus, it can be noted that the pixel circuit PC included in the sub-pixel SP is illustrated in the form of a block.

In the above description, the timing controller 120, the scan driver 130, the data driver 140, and the like are described to be separate components. However, depending on a method for configuring a light emitting display device, one or more of the timing controller 120, the scan driver 130, and the data driver 140 can be integrated into one IC.

An external compensation circuit including an initialization circuit for initializing a sub-pixel, a sensing circuit for sensing a sub-pixel, a sampling circuit for sampling a sensing value, or the like can be included inside the data driver 140. However, the external compensation circuit can be embodied as a separate IC.

Figure 3:
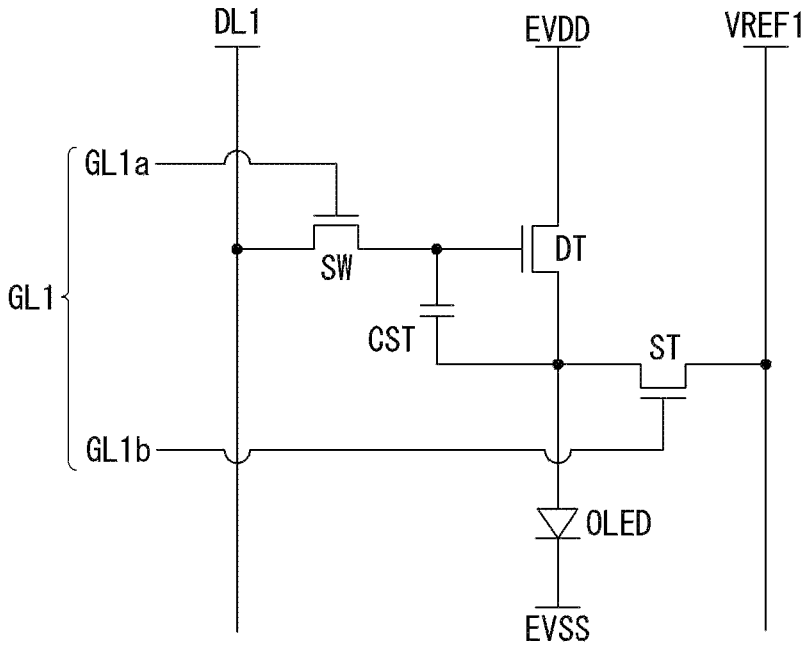
FIG. 3 is an equivalent circuit diagram illustrating a sub-pixel including a compensation circuit according to an embodiment of the present disclosure.
Figure 4:
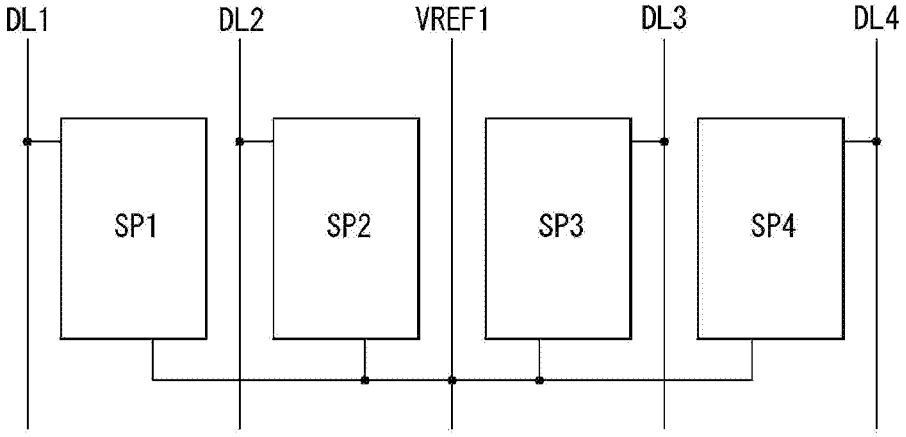
FIG. 4 is a diagram illustrating an example of a pixel embodied based on the sub-pixel of FIG. 3.

FIG. 3 is an equivalent circuit diagram illustrating a sub-pixel including a compensation circuit according to an embodiment of the present disclosure, and FIG. 4 is a diagram illustrating an example of a pixel embodied based on the sub-pixel (e.g., SP) of FIG. 3.

As shown in FIG. 3, the sub-pixel including the compensation circuit according to an embodiment of the present disclosure can include a switching transistor SW, a sensing transistor ST, a driving transistor DT, a capacitor $C_{ST}$ (or CST), and an organic light emitting diode OLED.

The switching transistor SW can have a gate electrode connected to a $1A^{th}$ scan line GL1*a*, a first electrode connected to a first data line DL1, and a second electrode connected to a gate electrode of the driving transistor DT. The driving transistor DT can have a gate electrode connected to the capacitor $C_{ST}$, a first electrode connected to the first power line EVDD, and a second electrode connected to an anode of the organic light emitting diode OLED.

The capacitor $C_{ST}$ can have a first electrode connected to the gate electrode of the driving transistor DT, and a second electrode connected to the anode of the organic light emitting diode OLED. The organic light emitting diode OLED can have the anode connected to the second electrode of the driving transistor DT and a cathode connected to a second power line EVSS. The sensing transistor ST can have a gate electrode connected to a $1B^{th}$ scan line GL1*b*, a first electrode connected to a sensing line VREF1, and a second electrode connected to a sensing node (a node to which the second electrode of the driving transistor and the anode of the organic light emitting diode OLED are connected).

The sensing transistor ST can be a compensation circuit that is added to compensate for degradation, a threshold voltage, or the like of the driving transistor DT and the organic light emitting diode OLED. The sensing transistor ST can acquire a sensing value through a sensing node defined between the driving transistor DT and the organic light emitting diode OLED. The sensing value acquired through the sensing node can be transferred to an external compensation circuit provided outside the sub-pixel through the sensing line VREF1.

The $1A^{th}$ scan line GL1*a* of the gate electrode of the switching transistor SW and the $1B^{th}$ scan line GL1*b* connected to the gate electrode of the sensing transistor ST can be configured to be separated as shown in the drawing or can be commonly connected. The gate electrode common connection structure can reduce the number of scan lines, and thus, reduction in an aperture ratio due to addition of the compensation circuit can be prevented.

As shown in FIG. 4, first to fourth sub-pixels SP1 to SP4 including the compensation circuit according to an embodiment of the present disclosure can be defined to configure one pixel. In this case, the first to fourth sub-pixels SP1 to SP4 can be arranged in an order to emit red, green, blue, and white light, but the present disclosure is not limited thereto. The first to fourth sub-pixels SP1 to SP4 including the compensation circuit can be connected to share one sensing line VREF1 and can be separately connected to first to fourth data lines DL1 to DL4, respectively.

However, FIG. 4 illustrates merely an example, and the present disclosure can also be applied to a display panel including sub-pixels having a different structure that is not illustrated and described above. The present disclosure can also be applied to a structure having a compensation circuit disposed in a sub-pixel or a structure without a compensation circuit in a sub-pixel.

Figure 5:
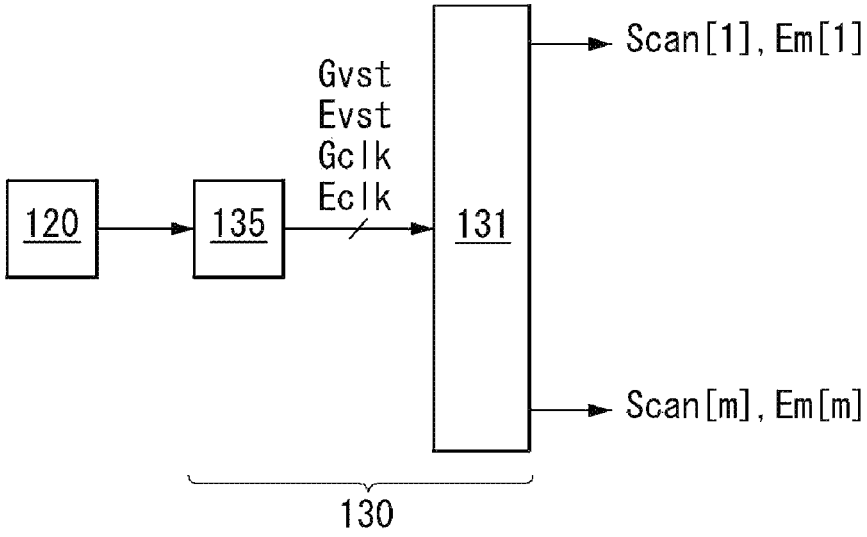
FIG. 5 is a diagram illustrating a first example of a structure of a device related to a scan driver using a gate in panel method.
Figure 6:
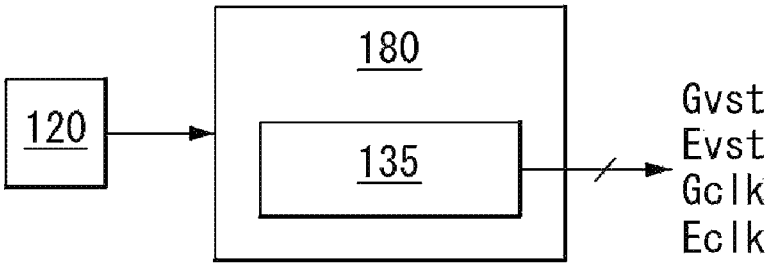
FIG. 6 is a diagram illustrating a second example of a structure of a device related to a scan driver using a gate in panel method.
Figure 7:
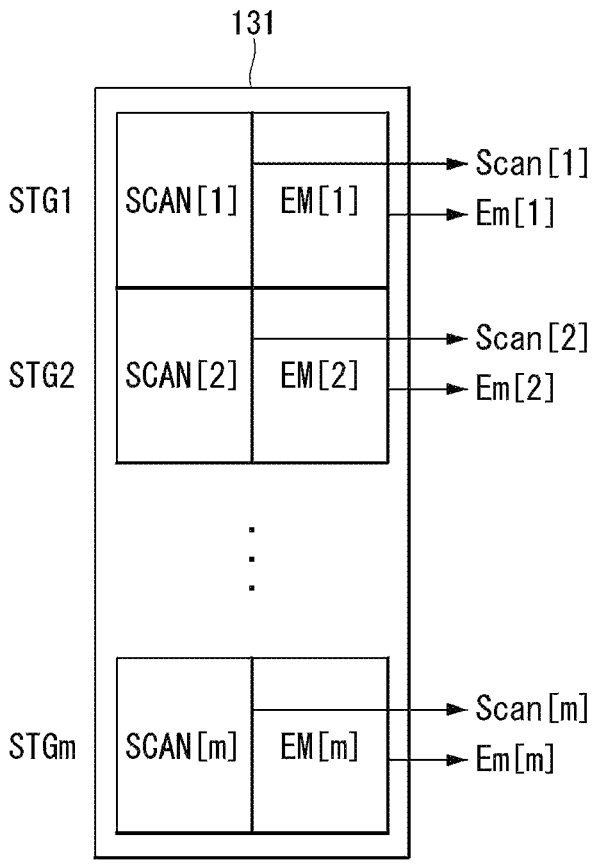
FIG. 7 is a diagram illustrating a first example of a structure of a shift register.
Figure 8:
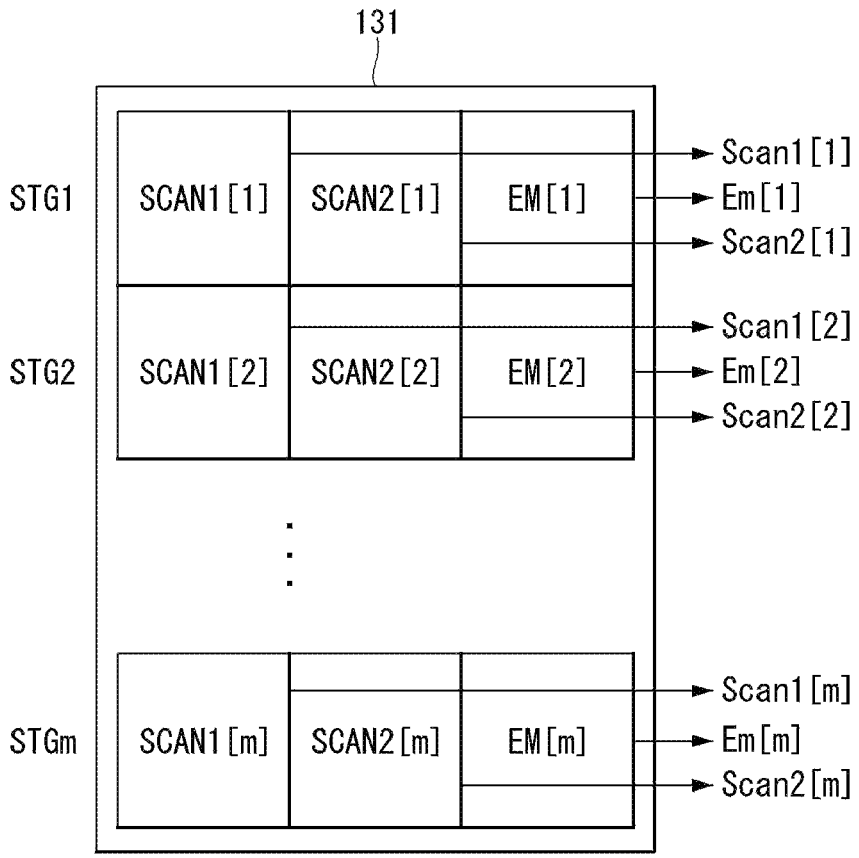
FIG. 8 is a diagram illustrating a second example of a structure of a shift register, all according to the embodiments of the present disclosure.

FIG. 5 is a diagram illustrating a first example of a structure of a device related to a scan driver using a gate in panel method, FIG. 6 is a diagram illustrating a second example of a structure of a device related to a scan driver using a gate in panel method, and FIG. 7 is a diagram illustrating a first example of a structure of a shift register, and FIG. 8 is a diagram illustrating a second example of a structure of a shift register.

As shown in FIG. 5, the scan driver 130 using a gate in panel method can include a shift register 131 and a level shifter 135. The level shifter 135 can generate and output a plurality of clock signals Gclk and Eclk, start signals Gvst and Evst, and the like based on signals output from the timing controller 120. The plurality of clock signals Gclk and Eclk can be generated and output in the form of different K phases (K being an integer equal to or greater than 2) such as 2-phase, 4 phase, or 8-phase.

The shift register 131 can be operated based on signals Gclk, Eclk, Gvst, and Evst, or the like output from the level shifter 135 and can output scan signals Scan[1] to Scan[m] for turning on or off a transistor formed on a display panel and emissive signals Em[1] to Em[m], where m is a number such as an integer greater than 1. The shift register 131 can be formed in the form of a thin film on the display panel using a gate in panel method. Thus, a portion of the scan driver 130, formed on the display panel, can be the shift register 131.

Differently from the shift register 131, the level shifter 135 can be formed in the form of an IC (integrated circuit). The level shifter 135 can be configured in the form of a separate IC as shown in FIG. 5, can be included inside the power supply 180 as shown in FIG. 6, or can be included inside other device(s).

As shown in FIGS. 7 and 8, the shift register 131 can include a plurality of stages STG1 to STGm, where m is a number such as an integer greater than 1. The plurality of stages STG1 to STGm can have a dependently connected structure and can receive at least one output signal of a front end or a rear end. One stage can output scan signal(s) for driving sub-pixels disposed on one scan line (or one horizontal line). The shift register 131 can be distributed and arranged in a display area but not a non-display area of the display panel, which will be described below in more detail.

Like in the first example shown in FIG. 7, the stages STG1 to STGm of the shift register 131 can respectively include scan signal generating circuits SCAN[1] to SCAN[m] and emissive signal generating circuits EM[1] to EM[m] where m is a number such as an integer greater than 1. For example, the first stage STG1 can include the first scan signal generating circuit SCAN[1] for outputting the first scan signal Scan[1] and the emissive signal generating circuit EM[1] for outputting the emissive signal Em[1].

The scan signal generating circuits SCAN[1] to SCAN[m] can output the scan signals Scan[1] to Scan[m] (where m is a number such as an integer greater than 1) through scan lines of the display panel. The emissive signal generating circuits EM[1] to EM[m] can output the emissive signals Em[1] to Em[m] through emissive signal lines of the display panel.

Like in the second example shown in FIG. 8, the stages STG1 to STGm of the shift register 131 can respectively include first scan signal generating circuits SCAN1[1] to SCAN1[m], second scan signal generating circuits SCAN2[1] to SCAN2[m], and the emissive signal generating circuits EM[1] to EM[m], where m is a number such as an integer greater than 1. For example, the first stage STG1 of the shift register 131 can include the first scan signal generating circuit SCAN1[1] for outputting the first scan signal Scan1[1], the second scan signal generating circuit SCAN2[1] for outputting the second scan signal Scan2[1], and the emissive signal generating circuit EM[1] for outputting the emissive signal Em[1].

The first scan signal generating circuits SCAN1[1] to SCAN1[m] can output first scan signals Scan1[1] to Scan1[m] (where m is a number such as an integer greater than 1) through first scan lines of the display panel. The second scan signal generating circuits SCAN2[1] to SCAN2[m] can output the second scan signals Scan2[1] to Scan2[m] (where m is a number such as an integer greater than 1) through second scan lines of the display panel. The emissive signal generating circuits EM[1] to EM[m] can output the emissive signals Em[1] to Em[m] through emissive signal lines of the display panel.

The first scan signals Scan1[1] to Scan1[m] can be used as a signal for driving an $A^{th}$ transistor (e.g., a switching transistor) included in sub-pixels. The second scan signals Scan2[1] to Scan2[m] can be used as a signal for driving a $B^{th}$ transistor (e.g., a sensing transistor) included in sub-pixels.

The emissive signals Em[1] to Em[m] can be used as a signal for driving a $C^{th}$ transistor (e.g., a transistor for controlling emission) included in sub-pixels. For example, when the transistor for controlling emission of the sub-pixels is controlled using the emissive signals Em[1] to Em[m], a time for emitting light of the organic light emitting diode can be varied.

Figure 9:
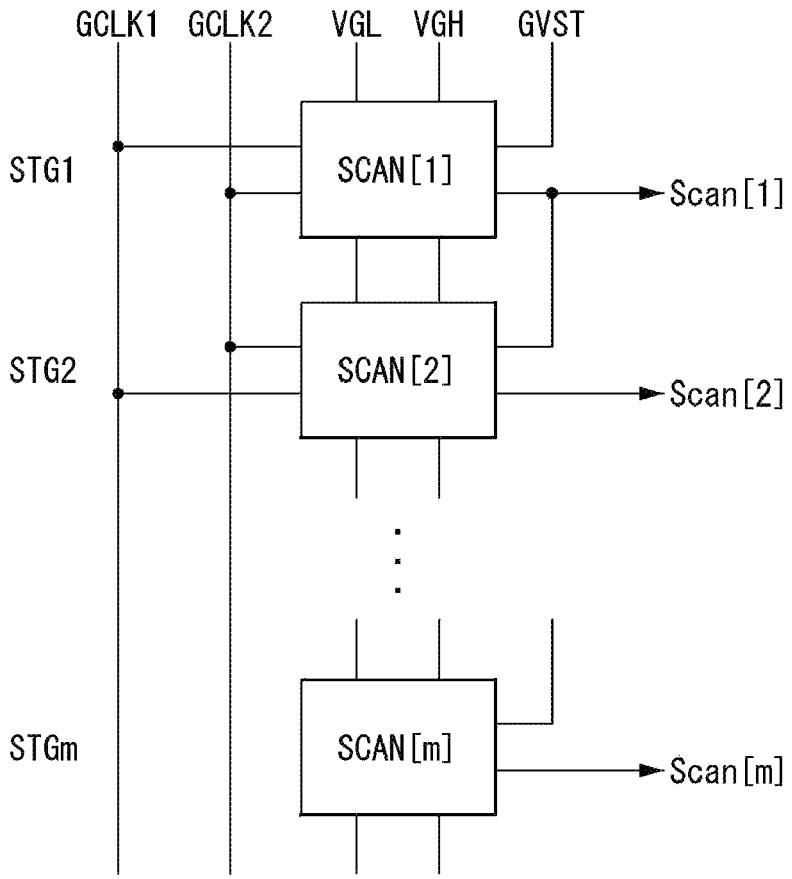
FIGS. 9 and 10 are diagrams illustrating an example of a structure of a stage of the scan signal generating circuits and emissive signal generating circuits shown in FIG. 7, and FIGS. 11 and 12 are diagrams illustrating an example of a structure of a circuit of a shift register that is commonly used in a signal generating circuit, all according to the embodiments of the present disclosure.
Figure 10:
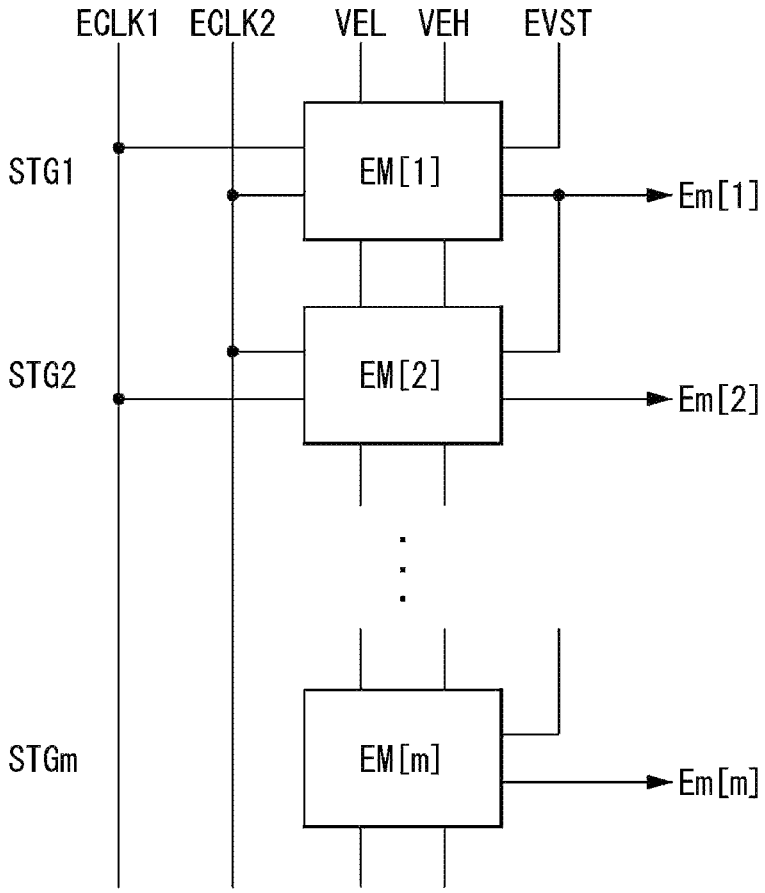
Figure 11:
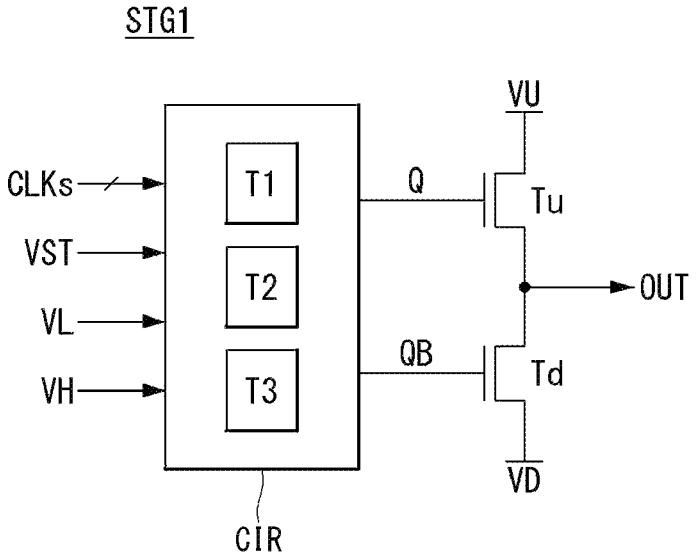
Figure 12:
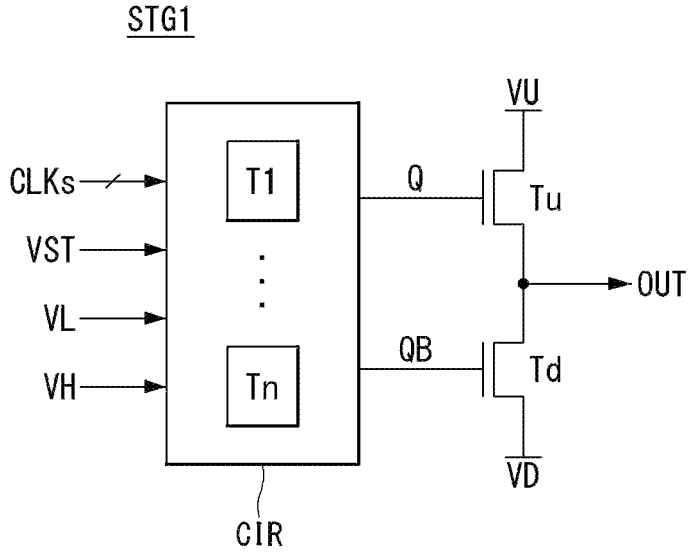

FIGS. 9 and 10 are diagrams illustrating an example of a structure of a stage of the scan signal generating circuits and emissive signal generating circuits shown in FIG. 7, and FIGS. 11 and 12 are diagrams illustrating an example of a structure of a circuit of a shift register that is commonly used in a signal generating circuit.

As shown in FIG. 9, the scan signal generating circuits SCAN[1] to SCAN[m] of first to $M^{th}$ stages STG1 to STGm can be connected a $1G^{th}$ clock signal line GCLK1, a $2G^{th}$ clock signal line GCLK2, a first stage signal line GVST, a $1G^{th}$ voltage line VGH, and a $2G^{th}$ voltage line VGL.

The scan signal generating circuits SCAN[1] to SCAN[m] of the first to $M^{th}$ stages STG1 to STGm can output the scan signals Scan[1] to Scan[m] based on a $1G^{th}$ clock signal applied through the $1G^{th}$ clock signal line GCLK1, a $2G^{th}$ clock signal applied through the $2G^{th}$ clock signal line GCLK2, a first start signal applied through the first stage signal line GVST, a $1G^{th}$ voltage applied through the $1G^{th}$ voltage line VGH, and a $2G^{th}$ voltage applied through the $2G^{th}$ voltage line VGL.

The scan signal generating circuit SCAN[1] of the first stage STG1 can be connected to the first stage signal line GVST, but an output signal of the scan signal generating circuit SCAN[1] of the first stage STG1 positioned at a front end can be used as a first start signal for the scan signal generating circuit SCAN[2] of the second stage STG2. Accordingly, the scan signal generating circuit SCAN[2] of the second stage STG2 can be connected to an output terminal of the scan signal generating circuit SCAN[1] of the first stage STG1 instead of the first stage signal line GVST.

As shown in FIG. 10, the emissive signal generating circuits EM[1] to EM[m] of the first to $M^{th}$ stages STG1 to STGm can be connected to a $1E^{th}$ clock signal line ECLK1, a $2E^{th}$ clock signal line ECLK2, a second start signal line EVST, a $1E^{th}$ voltage line VEH, and a $2E^{th}$ voltage line VEL.

The emissive signal generating circuits EM[1] to EM[m] of the first to $M^{th}$ stages STG1 to STGm can output the emissive signals Em[1] to Em[m] based on a $1E^{th}$ clock signal applied through the $1E^{th}$ clock signal line ECLK1, a $2E^{th}$ clock signal applied through the $2E^{th}$ clock signal line ECLK2, a second start signal applied through the second start signal line EVST, a $1E^{th}$ voltage applied through the $1E^{th}$ voltage line VEH, and a $2E^{th}$ voltage applied through the $2E^{th}$ voltage line VEL.

The emissive signal generating circuit EM[1] of the first stage STG1 can be connected to the second start signal line EVST, but an output signal of the emissive signal generating circuit EM[1] of the first stage STG1 positioned at a front end can be used as a second start signal for an emissive signal generating circuit EM[2] of the second stage STG2. Accordingly, the emissive signal generating circuit EM[2] of the second stage STG2 can be connected to an output terminal of the emissive signal generating circuit EM[1] of the first stage STG1 instead of the second start signal line EVST.

Thus far, the examples of FIGS. 7 to 10 have been illustrated and described to aid in understanding of the shift register 131, but they are merely exemplary, and the present disclosure is not limited thereto, and thus, embodiments can also be configured to output more diversified and more signals.

Hereinafter, a structure of a circuit of a shift register that is commonly used in the scan signal generating circuits SCAN[1] to SCAN[m] of the first to $M^{th}$ stages STG1 to STGm and the emissive signal generating circuits EM[1] to EM[m] of the first to $M^{th}$ stages STG1 to STGm will now be described below.

As shown in FIGS. 11 and 12, a shift register circuit of the first stage STG1 can include a node controller CIR for controlling a Q node Q and a QB node QB and output circuits Tu and Td.

The node controller CIR can be connected to K-phase clock signal lines CLKs, a start signal line VST, a first voltage line VH, and a second voltage line VL and can control charging and discharging of the Q node Q and the QB node QB based on signals and voltage applied to the connected elements.

A shown in FIG. 11, the node controller CIR can be configured to control charging and discharging of the Q node Q and the QB node QB based on a simple circuit including first to third transistors (T1 to T3). In addition, as shown in FIG. 12, the node controller CIR can be configured to control charging and discharging of the Q node Q and the QB node QB based on a complicated circuit (e.g., a compensation circuit, a stabilizing circuit, or a reset circuit) including first to $N^{th}$ transistors T1 to Tn (n being an integer equal to or greater than 3).

The output circuits Tu and Td can be connected to the Q node Q and the QB node QB, a first signal end or first voltage end VU, and a second signal end or second voltage end VD, and can output a scan high voltage or a scan low voltage based on a signal or potential that is exerted or applied to the connected element. The first signal end or first voltage end VU and the second signal end or second voltage end VD can refer to a clock signal line or a first voltage line.

The output circuits Tu and Td can be operated based on the first output circuit Tu, the second output circuit Td, a capacitor, and the like and can be configured to output a scan high voltage or a scan low voltage through an output end OUT. The first output circuit Tu and the second output circuit Td can be embodied as a switching transistor with the same size (the same width and the same length) as the first to third transistors (T1 to T3).

The switching transistor can be configured in any form as long as the switching transistor performs only a function of a simple switching operation of a signal differently from the buffer transistor. In addition, the switching transistor has a smaller size than the buffer transistor, and thus, when a thin film transistor is embodied in a limited region, the switching transistor can be more advantageous than the buffer transistor. However, when there is no spatial limit, the first output circuit Tu and the second output circuit Td can be embodied as a buffer transistor like in the conventional art. For example, when there is a spatial limit, the output circuits Tu and Td can be selected as a switching transistor, and when there is no spatial limit, the output circuits Tu and Td can be selected as a buffer transistor. As such, the output circuits Tu and Td are embodied as a switching transistor or a buffer transistor for the above reason.

Although an example in which the first to third transistors (T1 to T3), the first output circuit Tu, and the second output circuit Td are embodied as an n-type thin film transistor is illustrated, these can be embodied in a p-type thin film transistor or in a combination type of n-type and p-type thin film transistors.

Hereinafter, a shift register that is distributed and arranged in a display panel will be described, and in this case, will be described based on the model described with reference to FIG. 7 for convenience of description, but can also be applied to the model described with reference to FIG. 8 or other models.

Figure 13:
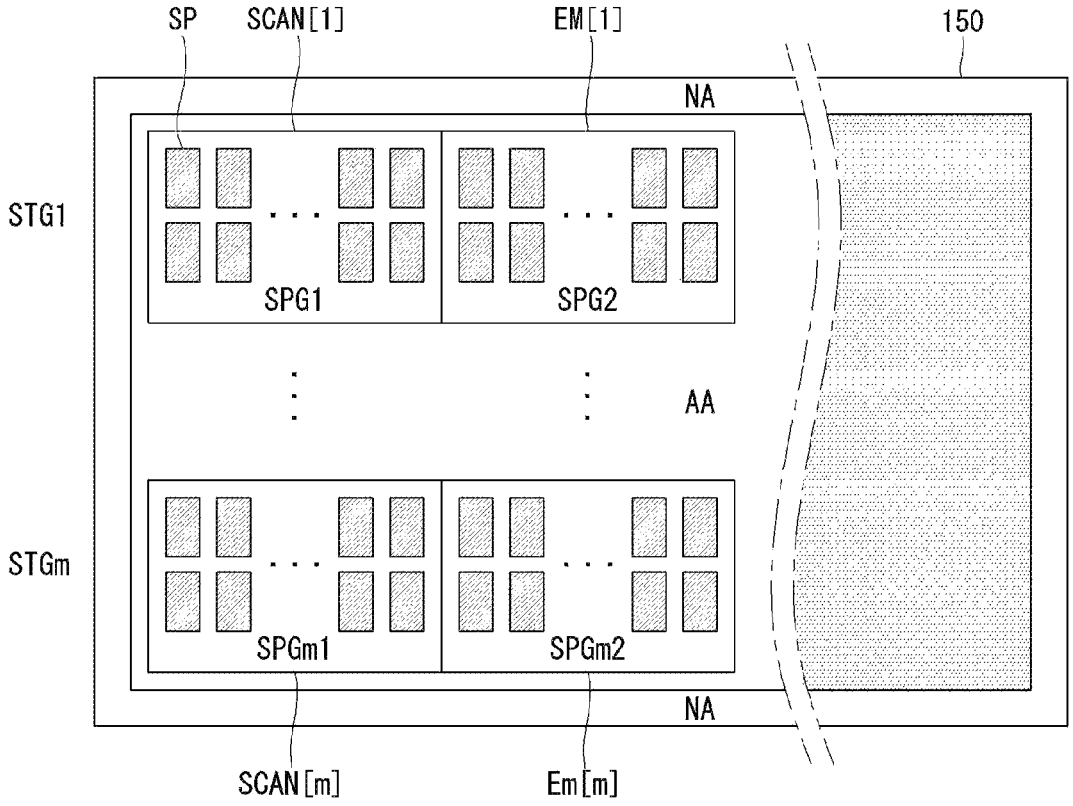
FIG. 13 is a diagram illustrating a portion of a shift register, which is distributed and arranged in a display panel, in the form of a block according to a first embodiment of the present disclosure.
Figure 14:
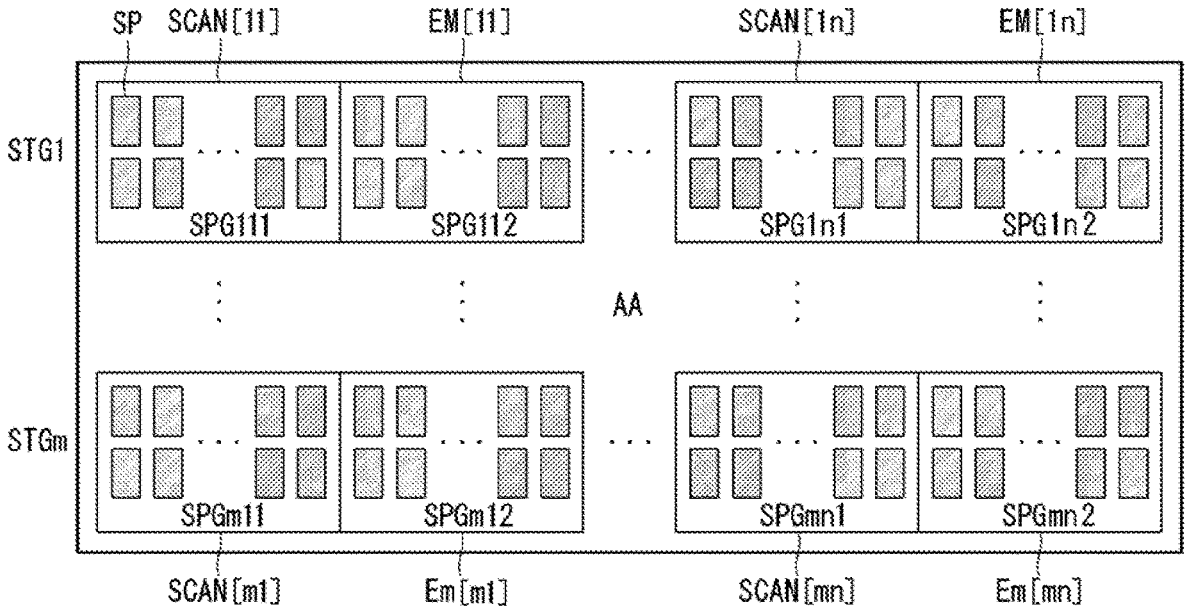
FIG. 14 is a schematic diagram illustrating an entire portion of the shift register shown in FIG. 13.

FIG. 13 is a diagram illustrating a portion of a shift register, which is distributed and arranged in a display panel, in the form of a block according to a first embodiment of the present disclosure, and FIG. 14 is a schematic diagram illustrating an entire portion of the shift register shown in FIG. 13.

As shown in FIGS. 13 and 14, the shift register including the scan signal generating circuits SCAN[1] to SCAN[m] of the first to $M^{th}$ stages STG1 to STGm and the emissive signal generating circuits EM[1] to EM[m] of the first to $M^{th}$ stages STG1 to STGm can be distributed and arranged in a display region AA of the display panel 150.

For example, the scan signal generating circuit SCAN[11] of the first stage STG1 can be distributed and arranged in a first sub-pixel group SPG111, and the emissive signal generating circuit EM[11] of the first stage STG1 can be distributed and arranged in a second sub-pixel group SPG112 adjacent to the first sub-pixel group SPG111. Here, one sub-pixel group can be defined as a plurality of sub-pixels that are adjacent to each other right and left as well as up and down on one or two scan line (or one or two horizontal line).

The first sub-pixel group SPG111 and the second sub-pixel group SPG112 are groups positioned at a left end point of the display region AA, and a $1N^{th}$ sub-pixel group SPG1*n*1 and a $2N^{th}$ sub-pixel group SPG1*n*2 can be positioned in the same form as the first sub-pixel group SPG111 and the second sub-pixel group SPG112 at a right end point that is opposite to the left end point of the display region AA. In addition, a first scan signal generating circuit SCAN[1n] of a first stage STG1 can be distributed and arranged in the $1N^{th}$ sub-pixel group SPG1n1, and an emissive signal generating circuit EM[1n] of the first stage STG1 can be distributed and arranged in the $2N^{th}$ sub-pixel group SPG1n2.

In this form, the $M^{th}$ scan signal generating circuit SCAN[m1] of an $M^{th}$ stage STGm can be distributed and arranged in an $M1^{th}$ sub-pixel group SPGm11, and an $M^{th}$ emissive signal generating circuit EM[m1] of the $M^{th}$ stage STGm can be distributed and arranged in an $M2^{th}$ sub-pixel group SPGm12 adjacent to the $M1^{th}$ sub-pixel group SPGm11. In addition, an $MN^{th}$ scan signal generating circuit SCAN[mn] of the $M^{th}$ stage STGm can be distributed and arranged in an $MN^{th}$ sub-pixel group SPGmn1, and an $MN^{th}$ emissive signal generating circuit EM[mn] of the $M^{th}$ stage STGm can be distributed and arranged in an $NN^{th}$ sub-pixel group SPGmn2 adjacent to the $MN^{th}$ sub-pixel group SPGmn1.

However, the above description is merely exemplary, and signal generating circuits in the same stage can be spaced apart from each other rather than being disposed adjacently to each other.

Figure 15:
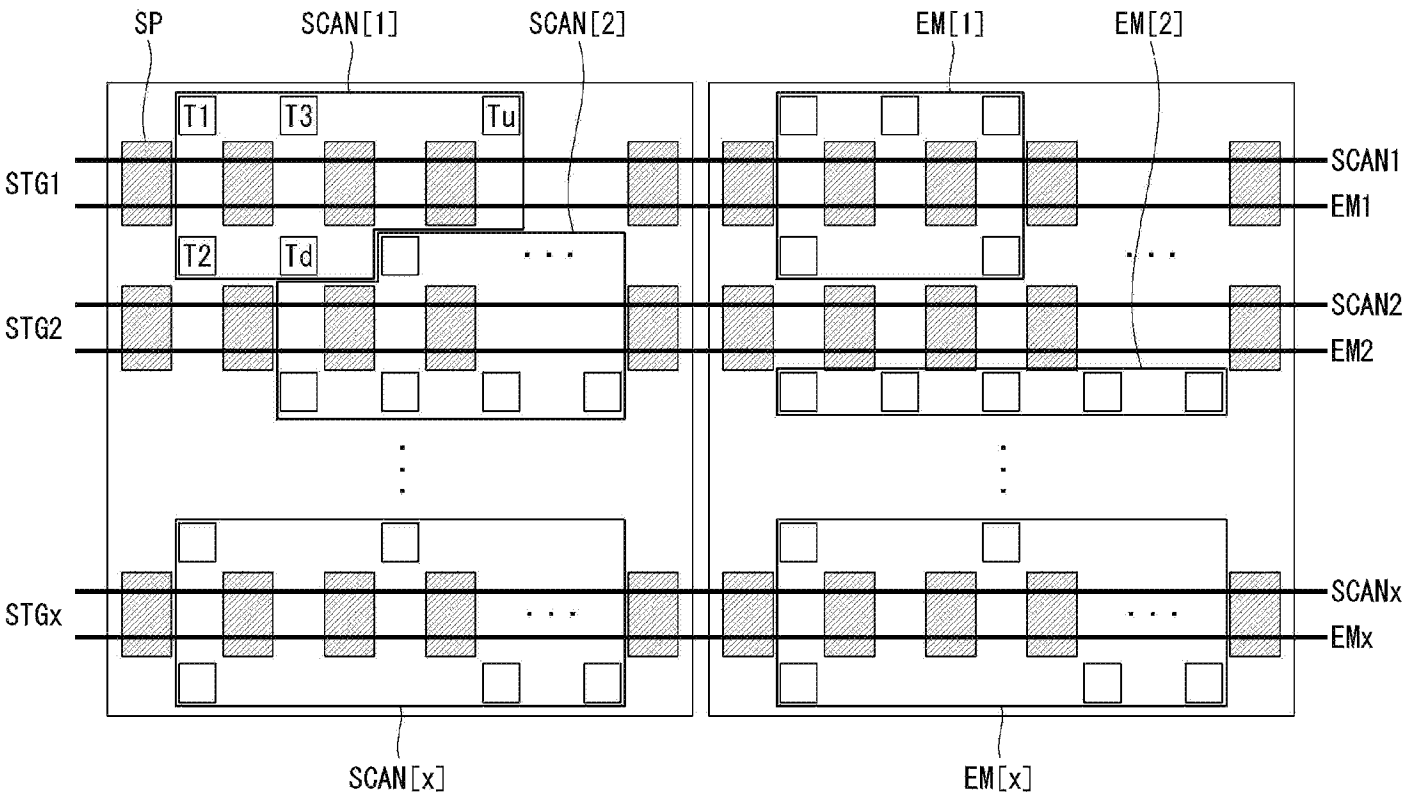
FIG. 15 is a diagram showing an example of arrangement of transistors included in the shift register shown in FIG. 13 according to a second embodiment of the present disclosure.
Figure 16:
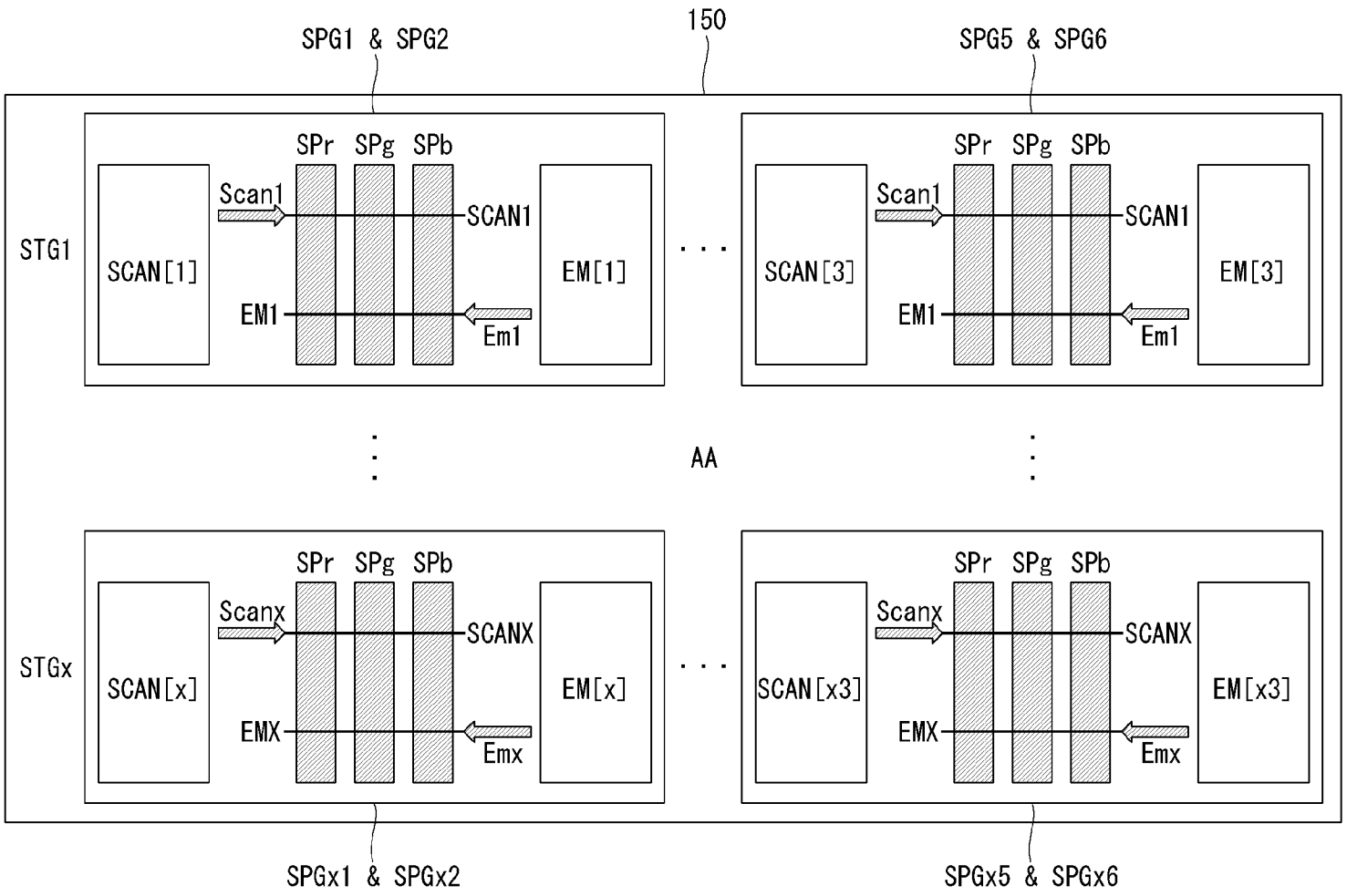
FIG. 16 is a diagram showing an example of an output form for each block of the shift register shown in FIG. 13.

FIG. 15 is a diagram showing an example of arrangement of transistors included in the shift register shown in FIG. 13 according to a second embodiment of the present disclosure, and FIG. 16 is a diagram showing an example of an output form for each block of the shift register shown in FIG. 13.

As shown in FIG. 15, the first scan signal generating circuit SCAN[1] of the first stage STG1 and the first emissive signal generating circuit EM[1] of the first stage STG1 can include node controllers T1 to T3 (or CIR), the output circuits Tu and Td, and the like. As described above, the node controllers T1 to T3 can include the first transistor (T1) to the third transistor (T3), and the output circuits Tu and Td can include the first output circuit Tu and the second output circuit Td. According to the present embodiment, although an example in which the first scan signal generating circuit SCAN[1] of the first stage STG1 and the first emissive signal generating circuit EM[1] of the first stage STG1 are embodied based on circuits with the same structure is described, the two units can also be embodied based on circuits with different structures.

The first transistor (T1) to the third transistor (T3) and the first output circuit Tu and the second output circuit Td included in the first scan signal generating circuit SCAN[1] of the first stage STG1 can be arranged in a non-emissive area between sub-pixels included in the first sub-pixel group. For example, the first transistor T1, the third transistor T3, and the first output circuit Tu can be arranged in an upper non-emissive area defined in an upper end of the first sub-pixel group, and the second transistor T2 and the second output circuit Td can be arranged in a lower non-emissive area defined in a lower end of the first sub-pixel group.

The given drawing illustrates an example in which about four sub-pixels are defined as a first sub-pixel group. However, one sub-pixel group can be defined as I (I being an integer equal to or greater than 2) sub-pixels.

The first emissive signal generating circuit EM[1] of the first stage STG1 can be distributed and arranged to the right adjacent to the first scan signal generating circuit SCAN[1] of the first stage STG1. The first emissive signal generating circuit EM[1] of the first stage STG1 can be distributed and arranged in a second sub-pixel group that is immediately adjacent to the first sub-pixel group.

As seen from an arrangement comparison between circuits included in the first scan signal generating circuit SCAN[1] of the first stage STG1 and the first emissive signal generating circuit EM[1] of the first stage STG1, even if the circuits included in the two elements are the same, arranged positions can be different from each other. Such an arrangement relationship can also be seen with reference to the second scan signal generating circuit SCAN[2] of the second stage STG2 and the second emissive signal generating circuit EM[2] of the second stage STG2 or an $X^{th}$ scan signal generating circuit SCAN[x] of an $X^{th}$ stage STGx and an $X^{th}$ emissive signal generating circuit EM[x] of the $X^{th}$ stage STGx which are considerably spaced apart therefrom.

As seen from the first transistor (T1) to the third transistor (T3) and the first output circuit Tu and the second output circuit Td arranged in FIG. 15, these can be uniformly distributed and arranged in an upper non-emissive area and a lower non-emissive area defined in one sub-pixel group, can be distributed and arranged in one line in the upper or lower non-emissive area, or can be arranged in a dense type or a separation type.

As shown in FIG. 16, the first scan signal generating circuit SCAN[1] of the first stage STG1 and the first emissive signal generating circuit EM[1] of the first stage STG1 can be connected to a first scan line SCANT and a first emissive signal line EM1 of sub-pixels SPr, SPg, and SPb included in the first sub-pixel group SPG1 and the second sub-pixel group SPG2. For example, SPr, SPg, and SPb can represent a red sub-pixel, a green sub-pixel and a blue sub-pixel, respectively.

The first scan signal generating circuit SCAN[1] of the first stage STG1 and the first emissive signal generating circuit EM[1] of the first stage STG1 can respectively output a first scan signal Scan1 and a first emissive signal Em1 for driving the sub-pixels SPr, SPg, and SPb included in the first sub-pixel group SPG1 and the second sub-pixel group SPG2.

A third scan signal generating circuit SCAN[3] of the first stage STG1 and a third emissive signal generating circuit EM[3] of the first stage STG1 can be connected to the first scan line SCAN1 and the first emissive signal line EM1 of the sub-pixels SPr, SPg, and SPb included in a fifth sub-pixel group SPG5 and a sixth sub-pixel group SPG6.

The third scan signal generating circuit SCAN[3] of the first stage STG1 and the third emissive signal generating circuit EM[3] of the first stage STG1 can respectively output the first scan signal Scan1 and the first emissive signal Em1 for driving the sub-pixels SPr, SPg, and SPb included in the fifth sub-pixel group SPG5 and the sixth sub-pixel group SPG6.

As seen from the above description, even if scan signal generating circuits included in the same stage and emissive signal generating circuits included in the same stage are spaced apart from each other, they can respectively output scan signals and emissive signals for driving sub-pixels arranged in the same line (or the same horizontal line).

In detail, the first scan signal generating circuit SCAN[1] of the first stage STG1 and the third scan signal generating circuit SCAN[3] of the first stage STG1 can be independently arranged and operated but can output first scan signals to be supplied to the first scan line SCAN1 at the same time. This can be applied in the same way to the first emissive signal generating circuit EM[1] of the first stage STG1 and the third emissive signal generating circuit EM[3] of the first stage STG1.

In addition, the above signal output relationship can be applied in the same way to the $X^{th}$ scan signal generating circuit SCAN[x] of the $X^{th}$ stage STGx and the $X^{th}$ emissive signal generating circuit EM[x] of the $X^{th}$ stage STGx, and an $X3^{th}$ scan signal generating circuit SCAN[x3] of the $X^{th}$ stage STGx and an $X3^{th}$ emissive signal generating circuit EM[x3] of the $X^{th}$ stage STGx, which are spaced apart therefrom.

As described above, even if signal generating circuits are spaced apart from each other, the signal generating circuits can respectively and simultaneously output (multiply output) scan signal and emissive signals for driving sub-pixels arranged in the same line (or the same horizontal line).

As a result, even if the size of a display panel is increased or the display panel has high resolution, a shift register according to an embodiment can apply a signal without an RC delay. In addition, the current method is not a method of applying a signal from a left side, a right side, or right and left sides of the display panel, and thus, since a switching transistor can be used to output a signal without use of a buffer transistor, it can be possible to enhance a freedom degree of a design and to also provide a dense design based on a small transistor.

Figure 17:
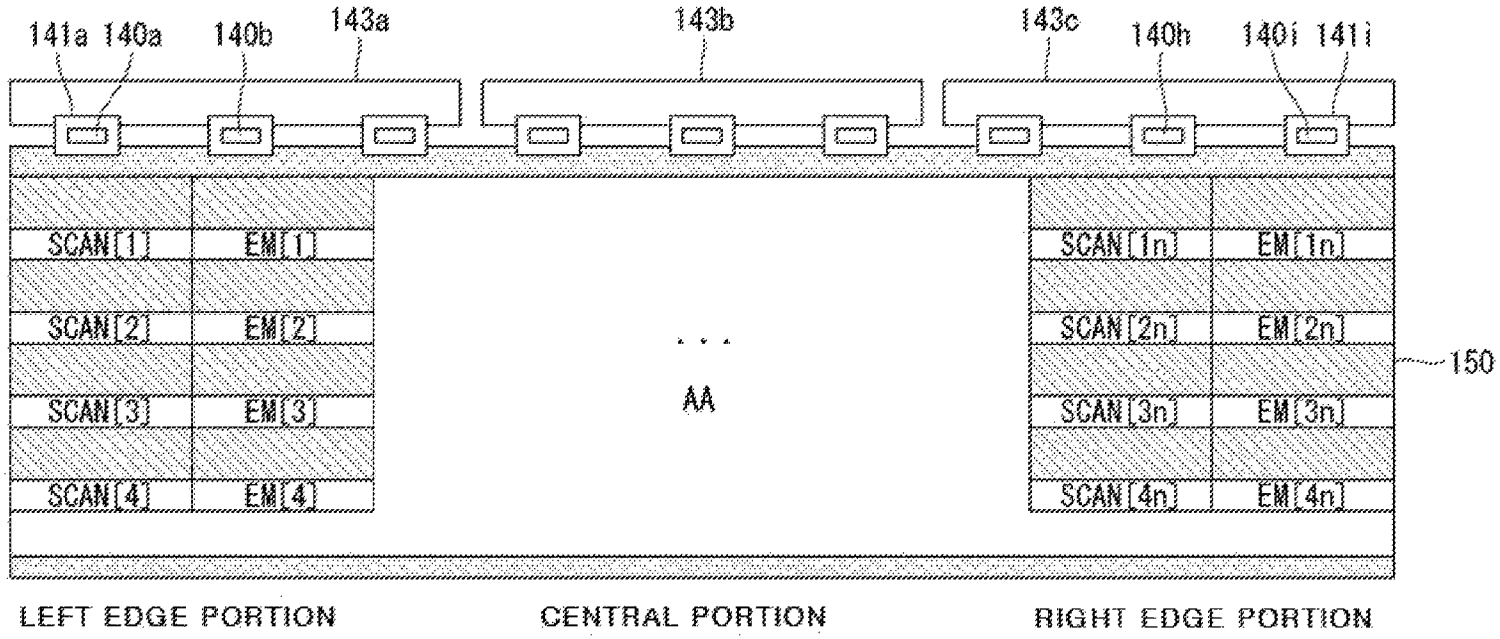
FIGS. 17 and 18 are diagrams showing examples of a portion of a shift register that is distributed and arranged in a display panel in the form of a stage according to a third embodiment of the present disclosure, and FIG. 19 and are diagrams for explaining advantages of the shift register according to the third embodiment.
Figure 18:
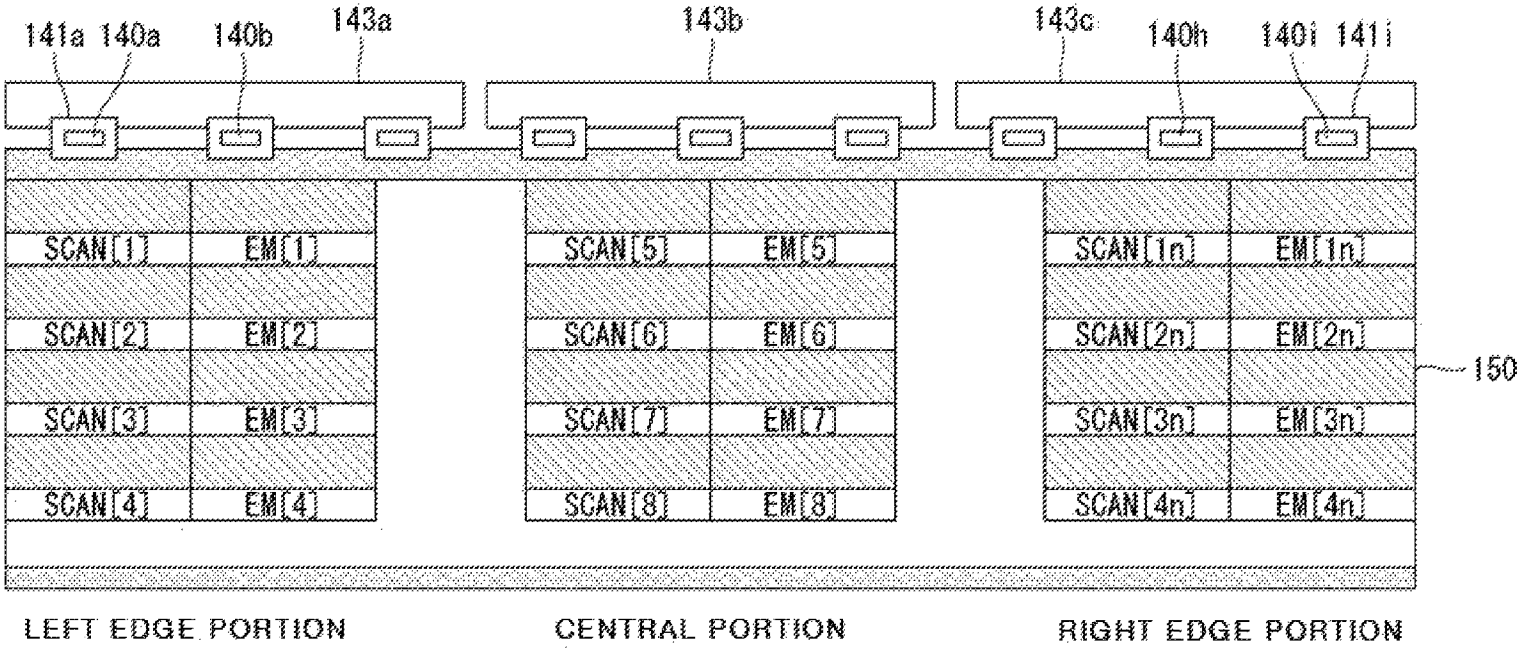
Figure 19:
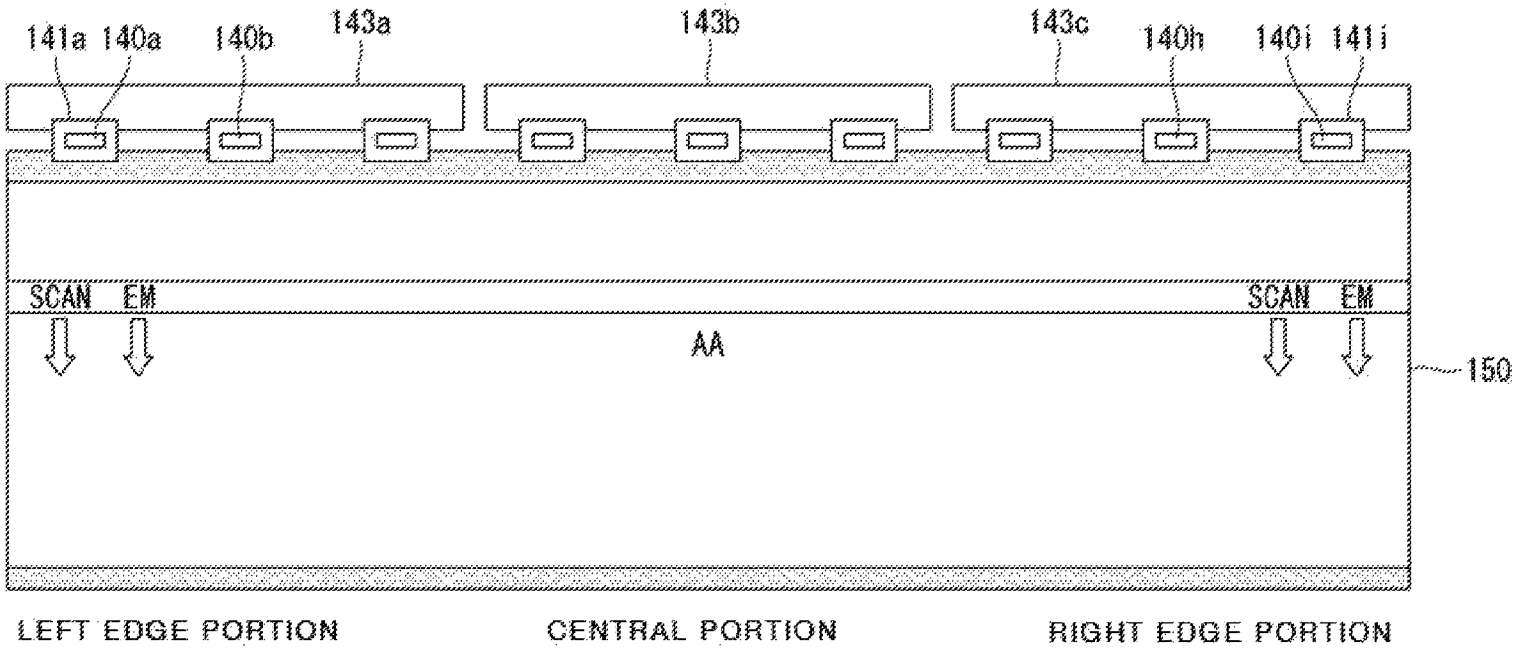

FIGS. 17 and 18 are diagrams showing examples of a portion of a shift register that is distributed and arranged in a display panel in the form of a stage according to a third embodiment of the present disclosure, and FIG. 19 and are diagrams for explaining advantages of the shift register according to the third embodiment.

In one example as shown in FIG. 17, the shift register including scan signal generating circuits SCAN[1] to SCAN[4] and SCAN[1*n*] to SCAN[4*n*] and emissive signal generating circuits EM[1] to EM[4] and EM[1*n*] to EM[4*n*] can be distributed and arranged in a left edge portion and a right edge portion that are defined in the display region AA of the display panel. For example, according to the first and second embodiments, the case in which the shift register is distributed and arranged over an entire portion of the display area is exemplified, but like in the third embodiment, the shift register can be distributed and arranged only in a left edge portion and a right edge portion rather than being arranged in a central portion of the display panel 150 (omitted).

In another example as shown in FIG. 18, the shift register including scan signal generating circuits SCAN[1] to SCAN[4], SCAN[5] to SCAN[8], and SCAN[1*n*] to SCAN[4*n*] and emissive signal generating circuits EM[1] to EM[4], EM[5] to EM[8], and EM[1*n*] to EM[4*n*] can be distributed and arranged in a left edge portion, a central portion, and a right edge portion that are defined in the display region AA of the display panel.

Figure 20:
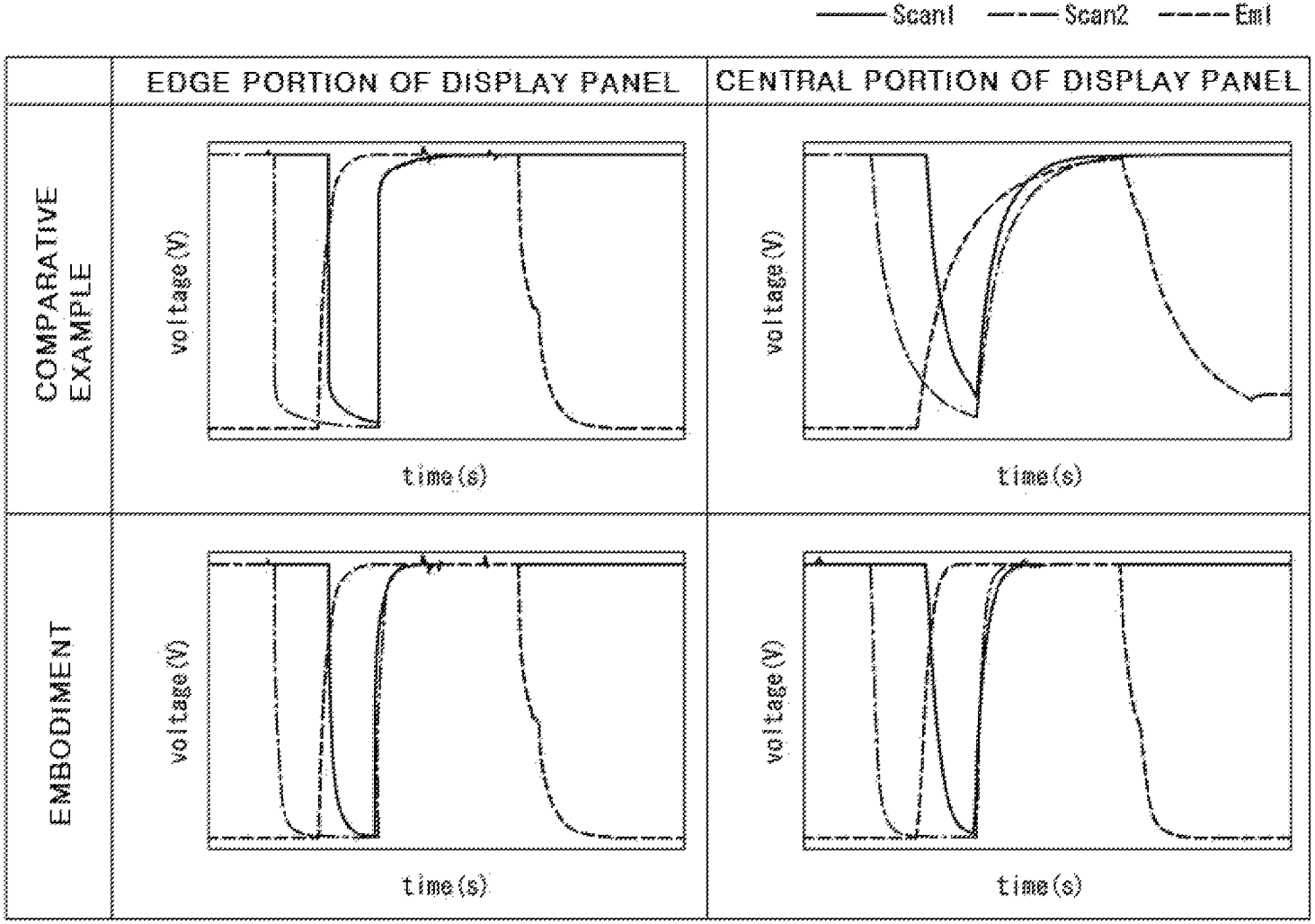

As shown in FIGS. 19 and 20, when the shift register is arranged in the form shown in the second example of the third embodiment or is distributed and arranged in an entire portion of the display region AA of the display panel 150 like in the first and second embodiments, it can be possible to output signals with the same condition in all areas (e.g., even if a signal delay occurs, signals have the same delay state). In addition, it can be possible to output signals having the same current/voltage condition in all areas.

As a result, it can be possible to reduce a deviation in output on a surface of the display panel and to also ensure output characteristics (it can be possible to overcome a problem in terms of increase in a load due to the size of the display panel). It can be possible to enhance display quality (to overcome image failure) by overcoming a problem in terms of driving time due to reduction in signal output (e.g., initialization in the case of external compensation, and reduction in sampling time deviation and error). In addition, it can be possible to drive a portion (block) for each area of the display panel, and thus, even if a portion of a scan line (or a horizontal line) is cut, it can be possible to normally drive a portion of the scan line.

In FIG. 20, Comparative Example and Embodiment are simulation results extracted based on the shift register configured in the form described with reference to FIG. 8. Here, Comparative Example corresponds to a condition in which a shift register is arranged in a non-display area, and Embodiment corresponds to a condition in which a shift register is distributed and arranged in a front portion of the display area according to one or more embodiment of the present invention. In addition, in FIGS. 17 to 19, reference numerals 141*a* to 141*i* refer to a flexible circuit board, reference numerals 140*a* to 140*i* refer to a data driver, and 143*a* to 143*c* refer to a printed circuit board. FIGS. 17 to 19 illustrate an example in which a light emitting display device is embodied in the form of a module based on the above substrate, but the present disclosure is not limited thereto.

Figure 21:
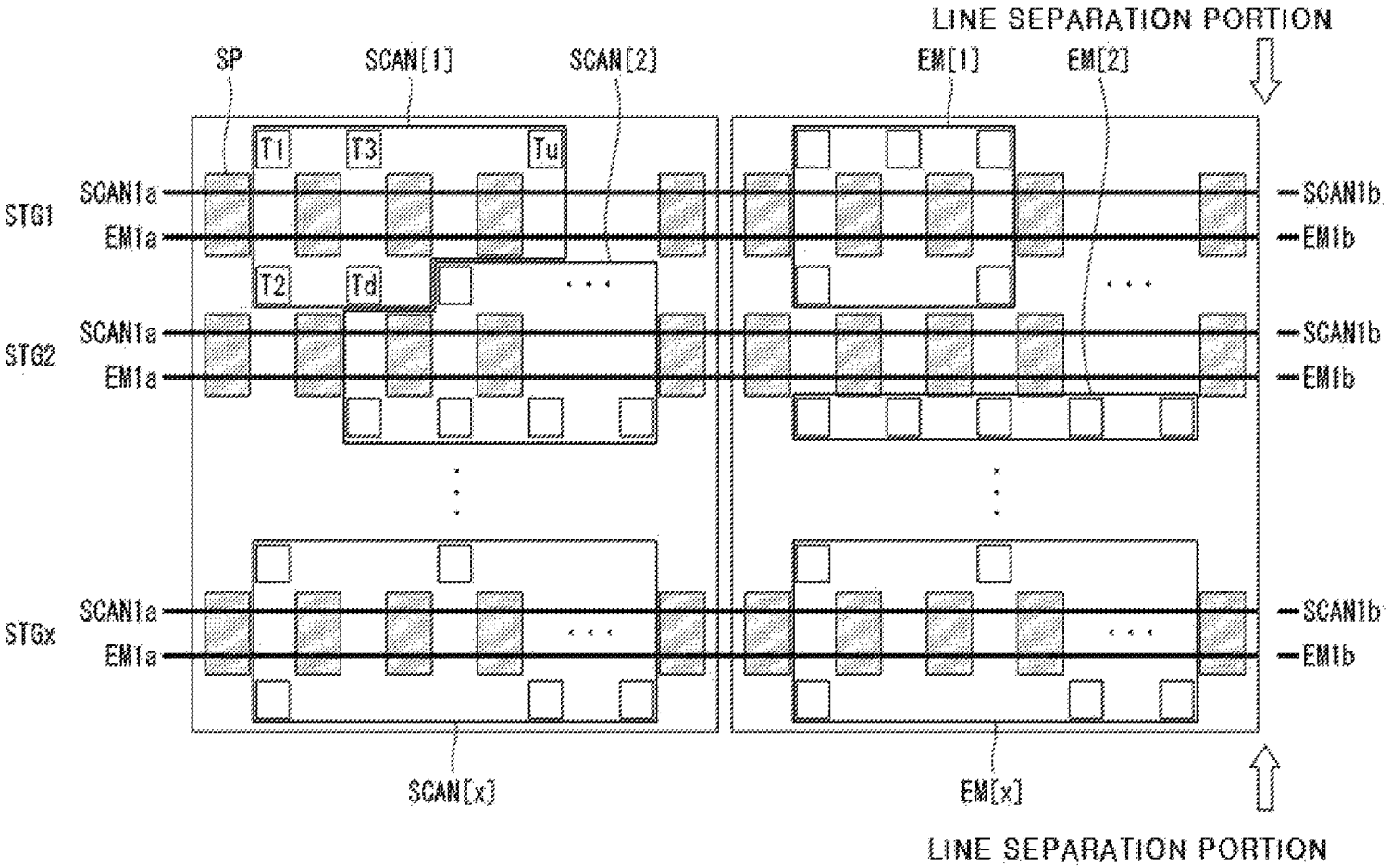
FIGS. 21 and 22 are diagrams showing examples of distribution and arrangement of transistors included in the shift register shown in FIG. 13 according to a fourth embodiment of the present disclosure.
Figure 22:
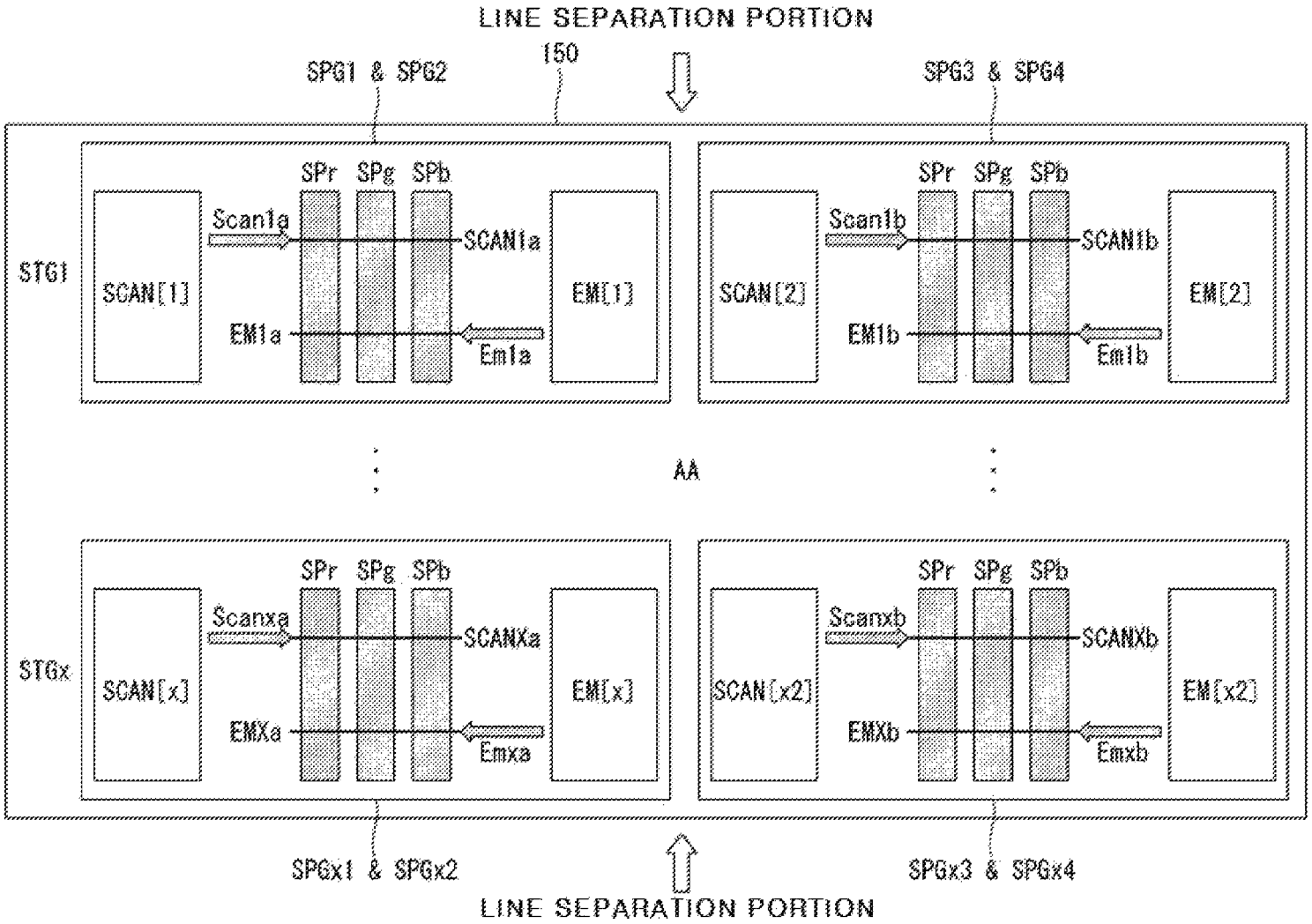

FIGS. 21 and 22 are diagrams showing examples of distribution and arrangement of transistors included in the shift register shown in FIG. 13 according to a fourth embodiment of the present disclosure.

As shown in FIG. 21, the first scan signal generating circuit SCAN[1] of the first stage STG1 and the first emissive signal generating circuit EM[1] of the first stage STG1 can respectively include the node controllers T1 to T3 (or CIR) and the output circuits Tu and Td. As described above, the node controllers T1 to T3 can include the first transistor (T1) to the third transistor (T3), and the output circuits Tu and Td can include the first output circuit Tu and the second output circuit Td. According to the present embodiment, an example in which the first scan signal generating circuit SCAN[1] of the first stage STG1 and the first emissive signal generating circuit EM[1] of the first stage STG1 are embodied based on circuits of the same structure is described, the two units can also be embodied based on circuits with different structures.

The first transistor (T1) to the third transistor (T3), the first output circuit Tu, and the second output circuit Td that are included in the first scan signal generating circuit SCAN[1] of the first stage STG1 can be arranged in a non-emissive area between sub-pixels included in the first sub-pixel group. For example, the first transistor T1, the third transistor T3, and the first output circuit Tu can be arranged in an upper non-emissive area defined in an upper end of the first sub-pixel group, and the second transistor T2 and the second output circuit Td can be arranged in a lower non-emissive area defined in a lower end of the first sub-pixel group.

The given drawing illustrates an example in which about four sub-pixels are defined as a first sub-pixel group. However, one sub-pixel group can be defined as I (I being an integer equal to or greater than 2) sub-pixels.

The emissive signal generating circuit EM[1] of the first stage STG1 can be distributed and arranged to the right adjacent to the first scan signal generating circuit SCAN[1] of the first stage STG1. The first emissive signal generating circuit EM[1] of the first stage STG1 can be distributed and arranged in a second sub-pixel group that is immediately adjacent to the first sub-pixel group.

As seen from an arrangement comparison between circuits included in the first scan signal generating circuit SCAN[1] of the first stage STG1 and the first emissive signal generating circuit EM[1] of the first stage STG1, even if the circuits included in the two elements are the same, arranged positions can be different from each other. Such an arrangement relationship can also be seen with reference to the second scan signal generating circuit SCAN[2] of the second stage STG2 and the second emissive signal generating circuit EM[2] of the second stage STG2 or the $X^{th}$ scan signal generating circuit SCAN[x] of the $X^{th}$ stage STGx and the $X^{th}$ emissive signal generating circuit EM[x] of the $X^{th}$ stage STGx which are considerably spaced apart therefrom.

When the shift register is arranged in all areas of the display panel in the above form, block driving can be performed on a sub-pixel group in which a scan signal generating circuit and an emissive signal generating circuit are arranged. As such, when it is possible to perform block driving, the sub-pixel group can be capable of being completely and independently driven without sharing a scan line and an emissive signal line (a signal output line) with other sub-pixel groups adjacent to the corresponding sub-pixel group on a horizontal line.

To this end, as shown in FIG. 21, one scan signal generating circuit and one emissive signal generating circuit can be defined as one signal generating circuit group, and a line separation group can be formed every between signal generating circuit groups. The line separation group can refer to open-circuit of a scan line and an emissive signal line between the signal generating circuit groups to have an independent driving system in units of signal generating circuit groups. Thus, the first scan signal generating circuit SCAN[1] and the first emissive signal generating circuit EM[1] of the first stage STG1 can be electrically connected to a $1A^{th}$ scan line SCAN1*a* and a $1A^{th}$ emissive signal line EM1*a*, but can have a separated structure therefrom rather than being electrically connected to a $1B^{th}$ scan line SCAN1*b* and a $1B^{th}$ emissive signal line EM1*b*.

As shown in FIG. 22, the first scan signal generating circuit SCAN[1] of the first stage STG1 and the first emissive signal generating circuit EM[1] of the first stage STG1 can be included in the first signal generating circuit group. Accordingly, the first scan signal generating circuit SCAN[1] of the first stage STG1 and the first emissive signal generating circuit EM[1] of the first stage STG1 can be electrically connected only to the $1A^{th}$ scan line SCAN1*a* and the $1A^{th}$ emissive signal line EM1*a* of the sub-pixels SPr, SPg, and SPb included in the first sub-pixel group SPG1 and the second sub-pixel group SPG2.

The first scan signal generating circuit SCAN[1] of the first stage STG1 and the first emissive signal generating circuit EM[1] of the first stage STG1 can respectively output only a $1A^{th}$ scan signal (Scan1*a*) and a $1A^{th}$ emissive signal Em1*a* for driving only the sub-pixels SPr, SPg, and SPb included in the first sub-pixel group SPG1 and the second sub-pixel group SPG2.

The second scan signal generating circuit SCAN[2] of the first stage STG1 and the second emissive signal generating circuit EM[2] of the first stage STG1 can be included in the second signal generating circuit group. Accordingly, the second scan signal generating circuit SCAN[2] of the first stage STG1 and the second emissive signal generating circuit EM[2] of the first stage STG1 can be electrically connected only to the $1B^{th}$ scan line SCAN1*b* and the $1B^{th}$ emissive signal line EM1*b* of the sub-pixels SPr, SPg, and SPb included in a third sub-pixel group SPG3 and a fourth sub-pixel group SPG4.

The second scan signal generating circuit SCAN[2] of the first stage STG1 and the second emissive signal generating circuit EM[2] of the first stage STG1 can respectively output only a $1B^{th}$ scan signal Scan1*b* and a $1B^{th}$ emissive signal Em1*b* for driving only the sub-pixels SPr, SPg, and SPb included in the third sub-pixel group SPG3 and the fourth sub-pixel group SPG4.

Figure 23:
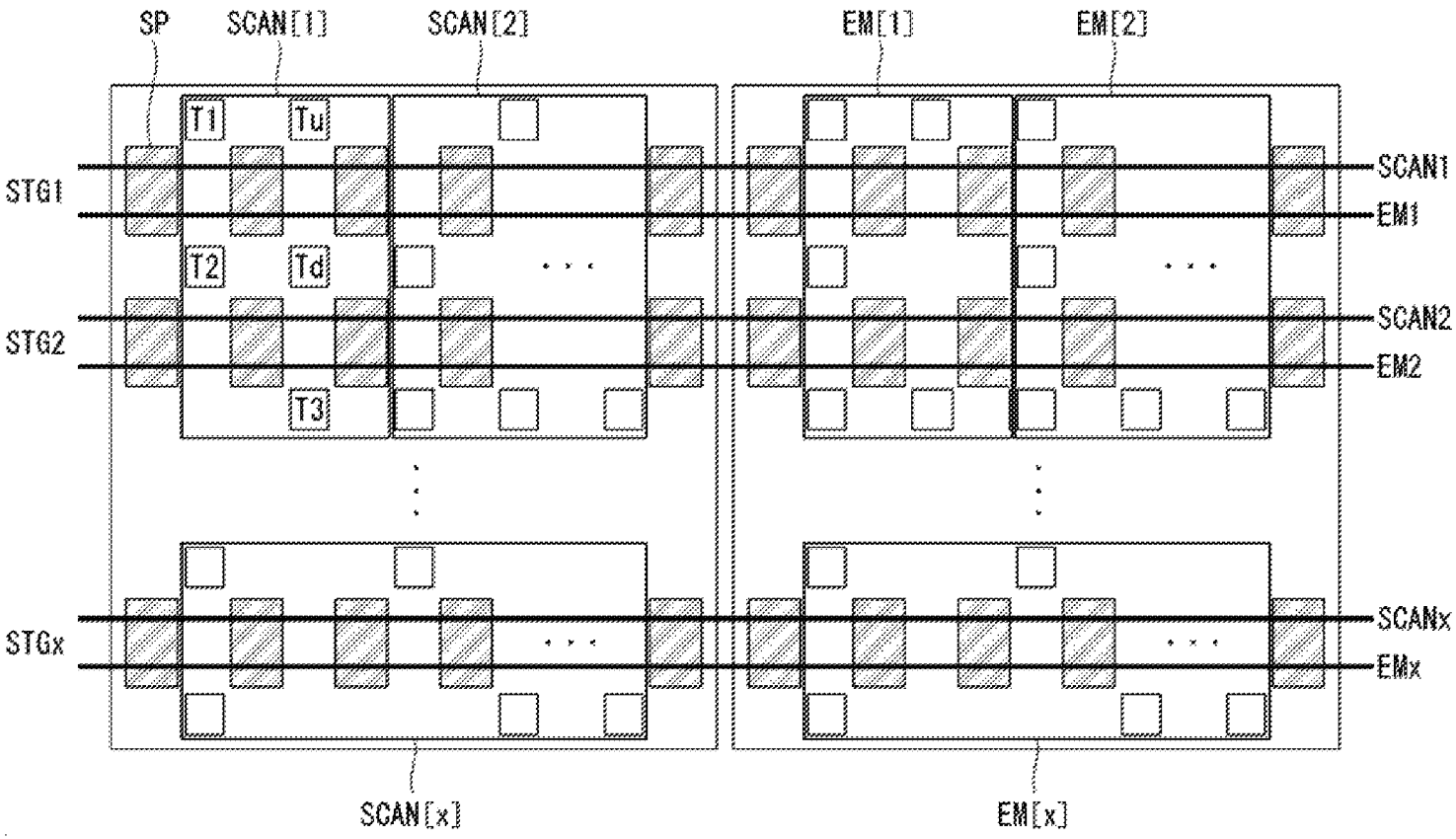
FIG. 23 is a diagram showing an example of distribution and arrangement of transistors included in the shift register shown in FIG. 13 according to a fifth embodiment of the present disclosure.

FIG. 23 is a diagram showing an example of distribution and arrangement of transistors included in the shift register shown in FIG. 13 according to a fifth embodiment of the present disclosure.

As shown in FIG. 23, the first scan signal generating circuit SCAN[1] of the first stage STG1 and the first emissive signal generating circuit EM[1] of the first stage STG1 can each include the node controllers T1 to T3 (or CIR), the output circuits Tu and Td, and the like. The first scan signal generating circuit SCAN[1] of the first stage STG1 can be connected to the first scan line SCANT and can output a first scan signal therethrough.

As described above, the node controllers T1 to T3 (or CIR) can include the first transistor (T1) to the third transistor (T3), and the output circuits Tu and Td can include the first output circuit Tu and the second output circuit Td. According to the present embodiment, an example in which the first scan signal generating circuit SCAN[1] of the first stage STG1 and the first emissive signal generating circuit EM[1] of the first stage STG1 are embodied based on circuits with the same structure is described, but the two elements can also be embodied based on circuits with different structures.

The first transistor (T1) to the third transistor (T3) and the first output circuit Tu and the second output circuit Td included in the first scan signal generating circuit SCAN[1] of the first stage STG1 can be arranged in a non-emissive area between sub-pixels included in the first sub-pixel group. Here, one sub-pixel group can be defined as a plurality of sub-pixels that are adjacent right and left as well as up and down based on at least two scan lines (or at least two horizontal lines).

The second scan signal generating circuit SCAN[2] of the second stage STG2 can be distributed and arranged to the right adjacent to the first scan signal generating circuit SCAN[1] of the first stage STG1. The second scan signal generating circuit SCAN[2] of the second stage STG2 can be distributed and arranged in the second sub-pixel group that is immediately adjacent to the first sub-pixel group. The second scan signal generating circuit SCAN[2] of the second stage STG2 can be connected to the second scan line SCAN2 and can output a second scan line therethrough.

The first emissive signal generating circuit EM[1] of the first stage STG1 can be distributed and arranged to the right directly or indirectly adjacent to the second scan signal generating circuit SCAN[2] of the second stage STG2. The first emissive signal generating circuit EM[1] of the first stage STG1 can be distributed and arranged in a third sub-pixel group directly or indirectly adjacent to the second sub-pixel group. The first emissive signal generating circuit EM[1] of the first stage STG1 can be connected to the first emissive signal line EM1 and can output a first emissive signal therethrough.

The second emissive signal generating circuit EM[2] of the second stage STG2 can be distributed and arranged to the right adjacent to the first emissive signal generating circuit EM[1] of the first stage STG1. The second emissive signal generating circuit EM[2] of the second stage STG2 can be distributed and arranged in a fourth sub-pixel group that is immediately adjacent to the third sub-pixel group. The second emissive signal generating circuit EM[2] of the second stage STG2 can be connected to a second emissive signal line EM2 and can output a second emissive signal therethrough.

As seen from an arrangement comparison between circuits included in the first scan signal generating circuit SCAN[1] of the first stage STG1 and the first emissive signal generating circuit EM[1] of the first stage STG1, even if the circuits included in the two elements are the same, arranged positions can be different from each other. Such an arrangement relationship can also be seen with reference to the second scan signal generating circuit SCAN[2] of the second stage STG2 and the second emissive signal generating circuit EM[2] of the second stage STG2 or the $X^{th}$ scan signal generating circuit SCAN[x] of the $X^{th}$ stage STGx and the $X^{th}$ emissive signal generating circuit EM[x] of the $X^{th}$ stage STGx that are considerably spaced apart therefrom.

When the shift register is arranged in all areas of the display panel in the above form, block driving can be performed on a sub-pixel group in which a scan signal generating circuit and an emissive signal generating circuit are arranged. As such, when it is possible to perform block driving, the sub-pixel group can be capable of being completely and independently driven without sharing a scan line and an emissive signal line with other sub-pixel groups adjacent to the corresponding sub-pixel group on a horizontal line.

The present disclosure is described based on a bottom emission-type display panel for emitting light in a direction toward a lower substrate on which sub-pixels are formed (deposited), and thus, the case in which the shift register is arranged in a non-emissive area has been described. However, when sub-pixels are formed in a top emission type for emitting light in a direction opposite to a lower substrate, the shift register can also be arranged in a circuit area (an area in which a transistor or the like is formed) that is not a non-emissive area.

To aid in understanding the present disclosure, an example in which a scan signal generating circuit and an emissive signal generating circuit are respectively distributed and arranged in a first sub-pixel group and a second sub-pixel has been described. However, the first sub-pixel group and the second sub-pixel group can be integrated into one sub-pixel group, and the scan signal generating circuit and the emissive signal generating circuit can also be distributed and arranged in the integrated sub-pixel group.

The present disclosure can realize a narrow bezel based on a structure in which a shift register for outputting a scan signal, etc. for displaying a display panel is distributed and arranged in a display area. According to the present disclosure, it can be possible to reduce a deviation in output on a surface of the display panel and to also ensure output characteristics (it can be possible to overcome a problem in terms of increase in a load due to the size of the display panel). According to the present disclosure, it can be possible to enhance display quality (to overcome image failure) by overcoming a problem in terms of driving time due to reduction in signal output (e.g., initialization in the case of external compensation, and reduction in sampling time deviation and error). In addition, according to the present disclosure, it can be possible to drive a portion (block) for each area of the display panel, and thus, even if a portion of a scan line (or a horizontal line) is cut, it can be possible to normally drive a portion of the scan line.

What is claimed is:

1. A light emitting display device comprising:

a display panel including a display area having sub-pixels configured to display an image and a non-display area that does not display an image; and a shift register including signal generating circuits distributed and arranged in the display area of the display panel and configured to output a signal for turning on or off a transistor included in the sub-pixels, wherein the signal generating circuits include at first type of signal generating circuit generating a first type of signal, and a second type of signal generating circuit generating a second type of signal, wherein the first and second types of signals are generated simultaneously and respectively output to sub-pixels arranged in a same horizontal line, wherein the signal generating circuits have driving systems that are independent in units of groups within the same horizontal line and each group of driving systems independently drives a corresponding group of sub-pixels, wherein the first type of signal generating circuit includes a scan signal generating circuit configured to output a scan signal for tuning on or off a switching transistor included in the sub-pixels, and wherein the second type of signal generating circuit includes an emissive signal generating circuit configured to output an emissive signal for turning on or off a transistor for controlling emission, included in the sub-pixels.

2. The light emitting display device of claim 1, wherein the signal generating circuits are disposed one by one in one sub-pixel group defined as a plurality of sub-pixels that are adjacent to each other right and left on one horizontal line.

3. The light emitting display device of claim 1, wherein the signal generating circuits are disposed one by one in one sub-pixel group defined as a plurality of sub-pixels that are adjacent to each other up, down, right, and left on two horizontal lines.

4. The light emitting display device of claim 1, wherein the signal generating circuits are embodied as switching transistors having channels with a same width and a same length.

5. The light emitting display device of claim 4, wherein the switching transistors are distributed and arranged in a non-emissive area that does not emit light of the sub-pixels.

6. The light emitting display device of claim 1, wherein the signal generating circuits are arranged in at least one position of a central portion, a left edge portion, and a right edge portion of the display area.

7. The light emitting display device of claim 1, wherein the signal generating circuits are distributed and arranged in an entire portion of the display area.

8. The light emitting display device of claim 1, wherein the sub-pixel groups respectively have signal output lines that are separated from each other in units of sub-pixel groups within the same horizontal line.

9. The light emitting display device of claim 1, wherein the signal generating circuits are arranged to be spaced apart from each other in the display area.

10. A light emitting display device comprising:

a display panel including a display area having sub-pixels configured to display an image and a non-display area that does not display an image; and a shift register including signal generating circuits distributed and arranged in the display area of the display panel and configured to output a signal for turning on or off a transistor included in the sub-pixels, wherein the signal generating circuits include at first type of signal generating circuit generating a first type of signal, and a second type of signal generating circuit generating a second type of signal, wherein the first and second types of signals are generated simultaneously and respectively output to sub-pixels arranged in a same horizontal line, wherein the signal generating circuits have driving systems that are independent in units of groups within the same horizontal line and each group of driving systems independently drives a corresponding group of sub-pixels, wherein the first type of signal generating circuit includes a scan signal generating circuit configured to output a scan signal for tuning on or off a switching transistor included in the sub-pixels, and wherein the second type of signal generating circuit includes an emissive signal generating circuit configured to output an emissive signal for turning on or off a transistor for controlling emission, included in the sub-pixels.

11. The light emitting display device of claim 10, wherein the signal generating circuits are embodied as switching transistors having channels with a same width and a same length.

12. The light emitting display device of claim 11, wherein the switching transistors are distributed and arranged in a non-emissive area that does not emit light of the sub-pixels.

13. The light emitting display device of claim 10, wherein the signal generating circuits are arranged in at least one position of a central portion, a left edge portion, and a right edge portion of the display area.

14. The light emitting display device of claim 10, wherein the signal generating circuits are distributed and arranged in an entire portion of the display area.

15. A driving method of a light emitting display device comprising a display panel including a display area having sub-pixels for displaying an image and a non-display area that does not display an image, and a shift register including signal generating circuits distributed and arranged in the display area of the display panel and configured to output a signal for turning on or off a transistor included in the sub-pixels, the method comprising:

independently driving the signal generating circuits for respective blocks to simultaneously and respectively output a plurality of signals for turning on or off a transistor included in the sub-pixels arranged in a same horizontal line; and applying a data voltage through the transistor turned on by the signal output from the signal generating circuits for allowing the sub-pixels to emit light, wherein the signal generating circuits include at first type of signal generating circuit generating a first type of signal, and a second type of signal generating circuit generating a second type of signal, wherein the first and second types of signals are generated simultaneously, and respectively output to sub-pixels arranged in a same horizontal line, wherein the signal generating circuits have driving systems that are independent in units of groups within the same horizontal line and each group of driving systems independently drives a corresponding group of sub-pixels, wherein the first type of signal generating circuit includes a scan signal generating circuit configured to output a scan signal for tuning on or off a switching transistor included in the sub-pixels, and wherein the second type of signal generating circuit includes an emissive signal generating circuit configured to output an emissive signal for turning on or off a transistor for controlling emission, included in the sub-pixels.

16. The driving method of claim 15, wherein the signal generating circuits output the signal through signal output lines separated in units of sub-pixel groups.

17. The light emitting display device of claim 1, wherein the display panel includes a line separation for disconnecting a scan line and a light emitting signal line existing between the signal generating circuits.

* * * * *